US010995513B2

(12) United States Patent
Fraioli et al.

(10) Patent No.: US 10,995,513 B2
(45) Date of Patent: May 4, 2021

(54) AIR SUPPORTED STRUCTURES WITH FROZEN PRECIPITATION ACCUMULATION PREVENTION

(71) Applicant: Air Structures American Technologies, Inc., Rye Brook, NY (US)

(72) Inventors: Denise Fraioli, Pound Ridge, NY (US); Donato Joseph Fraioli, Pound Ridge, NY (US); Donato Michael Fraioli, White Plains, NY (US)

(73) Assignee: Air Structures American Technologies, Inc., Rye Brook, NY (US)

( * ) Notice: Subject to any disclaimer, the term of this patent is extended or adjusted under 35 U.S.C. 154(b) by 42 days.

(21) Appl. No.: 16/158,415

(22) Filed: Oct. 12, 2018

(65) Prior Publication Data

US 2019/0112830 A1 Apr. 18, 2019

Related U.S. Application Data

(60) Provisional application No. 62/571,575, filed on Oct. 12, 2017.

(51) Int. Cl.
*E04H 15/22* (2006.01)
*E04H 9/16* (2006.01)
(Continued)

(52) U.S. Cl.
CPC ..... *E04H 15/22* (2013.01); *E04D 13/103* (2013.01); *E04H 9/16* (2013.01); *E04H 15/12* (2013.01);
(Continued)

(58) Field of Classification Search
CPC ..... E04H 2015/205; E04H 15/22; E04H 2015/206; E04H 2015/207; E04H 15/12;
(Continued)

(56) References Cited

U.S. PATENT DOCUMENTS 3,294,605 A * 12/1966 Fischer ..... E04H 15/20 156/65
3,557,515 A 1/1971 MacCracken
(Continued)

FOREIGN PATENT DOCUMENTS

DE 2213869 A1 * 10/1973 ..... E04H 15/22
DE 2945209 A1 * 5/1981 ..... E04H 15/12
(Continued)

*Primary Examiner* — Ryan D Kwiecinski
*Assistant Examiner* — Matthew J Gitlin
(74) *Attorney, Agent, or Firm* — Heslin Rothenberg Farley & Mesiti P.C.; Kristian E. Ziegler, Esq.; John Boger, Esq.

(57) ABSTRACT

Air supported structures forming an enclosure via internal pressurized air, and methods of making same, are disclosed. The structures include an outer membrane defining an outer surface of the structure. The structures include an inner liner blanket coupled to the outer membrane via a plurality of spaced baffles extending from the outer membrane into the enclosure, the inner liner blanket and the inner surface of the outer membrane forming a heating pocket therebetween within the enclosure extending along a first portion of the outer membrane. The structures also include at least one input channel in communication with the heating pocket, and at least one heated air system configured to selectively direct a flow of heated air through the at least one input channel and into the heating pocket to heat the first portion of the outer membrane to remove and/or prevent frozen precipitation accumulation on the outer surface thereof.

16 Claims, 17 Drawing Sheets

(51) Int. Cl.
*E04D 13/10* (2006.01)
*E04H 15/12* (2006.01)
*E04H 15/20* (2006.01)

(52) U.S. Cl.
CPC .. *E04H 2015/202* (2013.01); *E04H 2015/205* (2013.01); *E04H 2015/207* (2013.01)

(58) Field of Classification Search
CPC ... E04H 15/201; E04H 15/206; E04H 15/207; E04H 15/202; E04H 9/16; E04H 2015/201; E04D 13/103
USPC ... 52/2.11, 2.13, 2.14, 2.18, 2.22, 2.23, 2.24
See application file for complete search history.

(56) References Cited

U.S. PATENT DOCUMENTS 3,661,693 A * 5/1972 Pierson ..... B29C 65/565 428/123
3,779,847 A * 12/1973 Turner ..... E04H 15/20 156/156
3,844,339 A * 10/1974 Kranz ..... E04H 15/20 165/46
4,004,380 A * 1/1977 Kwake ..... E04H 3/16 52/2.18
4,024,803 A * 5/1977 Linecker ..... E04B 1/74 454/185
4,041,653 A * 8/1977 Rain ..... E04H 15/22 52/2.19
4,186,530 A * 2/1980 Fraioli ..... E04H 15/20 52/2.19
4,257,199 A 3/1981 Kuboyama
4,559,746 A 12/1985 Ishler
4,936,060 A 6/1990 Gelinas et al.
6,282,842 B1 9/2001 Simens
6,282,843 B1 * 9/2001 Shibaike ..... E04H 15/20 52/2.11
6,360,496 B1 3/2002 Raccuglia
6,598,613 B2 7/2003 Fritzche et al.
7,135,332 B2 11/2006 Ouellette
8,887,654 B2 * 11/2014 Hoefler ..... B63B 7/06 114/264
8,991,111 B1 3/2015 Harkins
8,991,123 B2 3/2015 Micka et al.

FOREIGN PATENT DOCUMENTS

FR 2542025 A1 * 9/1984 ..... E04H 15/22
JP 05033530 A * 2/1993

* cited by examiner

AIR SUPPORTED STRUCTURES WITH FROZEN PRECIPITATION ACCUMULATION PREVENTION

CROSS-REFERENCE TO RELATED APPLICATION

This application perfects and claims the benefit of U.S. Provisional Patent Application No. 62/571,575, filed Oct. 12, 2017, entitled Air Supported Structures Configured to Remove Frozen Precipitation Accumulation, the entirety of which is hereby expressly incorporated herein by reference.

FIELD OF THE INVENTION

The present disclosure generally relates to air support structures, and more particularly to air support structures with improved snow melt configuration.

BACKGROUND OF THE INVENTION

Air supported structures are known. These structures are generally comprised of a main or outer sheet-like flexible membrane which defines an enclosure when air within the air supported structure is at a higher pressure than the air pressure outside of the air supported structure. The main flexible sheet-like membrane may be formed from a plurality of panels which are joined to each other at their edges to form the dome envelope of any size and shape. The outer surface of the outer flexible membrane forms at an exterior surface of the structures.

The outer flexible panels forming the outer membrane of the air supported structure are typically made from a substantially air-tight material that is strong, durable, lightweight and resistant to weather and airborne pollutants. Additionally, it is desirable that the material forming the outer membrane is flexible and configured such that adjacent panels can be coupled together to form a relatively strong composite structure. Air supported structures utilizing such material and panels advantageously resist tearing, such as tearing along the joints where the outer panels are joined.

Air supported structures are maintained by creating a positive pressure within the enclosure formed by the structure with respect to the atmospheric pressure outside of the structure. Typically, at least one inch of positive pressure is normally maintained within the enclosure with respect to the atmospheric pressure outside of the structure to maintain the outer membrane at a proper height and/or orientation. It will be understood that the actual pressure within the enclosure and the actual pressure exterior to the structure are not critical, so long as the pressure differential between the inside and the atmosphere is maintained at the required difference such that a positive pressure is always maintained within the enclosure.

While the outer membrane of current air supported structures may be sufficiently strong to withstand the positive pressure buildup within the enclosure and the weight of hardware or other mechanisms/devices coupled thereto, the structural integrity of the outer membrane may be compromised by excessive loads on the outer membrane from the buildup of frozen precipitation thereon (ice, snow, ice, slush, etc.). Further, the internal air pressure creation and maintenance systems of current air supported structures may not be able to maintain a sufficient internal air pressure to maintain the enclosure (i.e., elevate the roof portion of the structure) when large loads of frozen precipitation buildup on the outer membrane. In these ways, for example, accumulation of frozen precipitation on air supported structures may damage the structures, and potentially lead to collapse of the structures. Indeed, many failures which have occurred related to air supported structures have resulted from untreated accumulation of frozen precipitation on the roofs of the structures.

Typically, frozen precipitation that has accumulated on an air supported structure is removed manually. One or more worker typically climbs onto the roof portion of such structures and manually shovels or otherwise removes the frozen precipitation from the structures. Manual removal of frozen precipitation from air supported structures is therefore dangerous, labor intensive, costly and potentially damaging to the outer membrane. With very large air supported structures, such as those of several acres, manual removal of accumulated frozen precipitation is not feasible. Further, as frozen precipitation may accumulate on the roof portions of air supported structures relatively quickly, such as during environmental conditions that are too unsafe for manual removal and/or when sufficient manpower is unavailable, situations can occur when manual removal cannot be accomplished before excess loads from the buildup of frozen precipitation damage and/or collapse the structure.

Some air supported structures utilize heated air systems that create a flow of heated air within the enclosure to melt accumulated frozen precipitation on the roof portion thereof. However, many such hot air systems do not adequately prevent frozen precipitation accumulation and/or fully remove frozen precipitation accumulation. Further, such current heated air systems are not suitable and/or scalable for very large air supported structures. Still further, current heated air systems of air supported structures are not capable of adequately directing and/or redirecting heated air to one or more specific or particular areas of the structure to melt and/or prevent frozen precipitation accumulated thereon.

Thus, a need exists for air supported structures with improved frozen precipitation accumulation removal and prevention systems that are automatic and more efficient than traditional frozen precipitation removal methods. Further, improved frozen precipitation accumulation removal and prevention systems that are capable of concentrating and/or maximizing removal and/or prevention to particular areas of an air supported structure are also desirable.

While certain aspects of conventional technologies may be discussed to facilitate disclosure, Applicant in no way disclaims these technical aspects, and it is contemplated that the claimed inventions may encompass one or more conventional technical aspects.

In this specification, where a document, act or item of knowledge is referred to or discussed, this reference or discussion is not an admission that the document, act or item of knowledge or any combination thereof was, at the priority date, publicly available, known to the public, part of common general knowledge, or otherwise constitutes prior art under the applicable statutory provisions; or is known to be relevant to an attempt to solve any problem with which this specification is concerned.

SUMMARY OF THE INVENTION

The present disclosure may address one or more of the problems and deficiencies of the art discussed above. However, it is contemplated that the present disclosure may prove useful in addressing other problems and deficiencies in a number of technical areas. Therefore, the claimed inventions and present disclosure should not necessarily be construed as limited to addressing any of the particular problems or deficiencies discussed herein.

Briefly, the present disclosure satisfies the need for improved frozen precipitation accumulation removal and prevention systems of air supported structures, and corresponding methods of removing and preventing frozen precipitation accumulation on air supported structures, which provide automatic and dynamic frozen precipitation removal/prevention in particular areas of the structures.

Generally, the air supported structures with frozen precipitation accumulation removal and prevention systems or configurations include a heated air handling system that directs heated air within inner segments at the interior surface of an outer membrane of a flexible roof assembly of the air supported structures (onto which frozen precipitation may accumulate). The inner panels of the structures include tab members that are attached to and extend from the outer membrane of the air supported structure. The tab members extends away from an interior surface of the outer membrane inwardly towards the interior of the enclosure and/or downwardly towards the ground. The tab members (and the inner segments themselves) also extend laterally across the width and/or length of the enclosure, depending upon the orientation or design (e.g., shape) of the structure. The inner segments also include at least one inner liner panel attached to a first side or face of a first tab member and a second side or face of a second tab member that is adjacent the first tab member. The at least one inner liner panel is spaced from the interior surface of the outer membrane to create an air pocket between the at least one inner liner panel, the outer membrane and the first and second tab members. Adjacent inner segments may share at least one respective tab member. The tab members may include at least one aperture extending therethrough such that adjacent air pockets of adjacent inner segments (separated by a tab member) are in fluid or air communication.

The air supported structures, and/or frozen precipitation accumulation removal and prevention systems or configurations thereof, may further include hot air systems that produce a flow of heated air through one or more input plenums. The input plenums may extend into the enclosure, and may include at least one enclosure vent configured to selectively direct at least some of the heated air into the enclosure. The heated air selectively directed into the enclosure via the at least one enclosure vent may act to heat the enclosure for the comfort of users and/or to heat the structure itself to prevent and/or melt frozen precipitation accumulation on the exterior of the outer membrane.

However, to more effectively prevent and/or melt frozen precipitation accumulation on the exterior of the outer membrane (e.g., if needed), the heated air may also be selectively directed into one or more of the air pockets between the outer membrane and the at least one inner liner panel of at least one inner segment via a distribution plenum that is in communication with the at least one input plenum. The heated air may thereby flow through the at least one air pocket of one or more inner segment to a distal end thereof. As noted above, the inner segments (and thereby the air pockets thereof) may extend laterally and/or longitudinally across a dimension (at least partially) of the structure. The distal end of one or more inner segment may be coupled to at least one return channel or vent that directs the heated air into the enclosure. In this way, the flow of heated air may remove and prevent the accumulation of frozen precipitation by heating the outer membrane and also heat the enclosure of the structure.

In one embodiment, the distal ends of the at least one pocket of one or more inner segments may be selectively closed via the at least one return channel or vent to direct the heated air through the at least one aperture of the tab members and into at least one air pocket of at least one inner segment that is proximate to an area of the outer membrane that requires or would benefit from additional heating. In such embodiments, the at least one return channel or vent in communication with inner segments of the structure can be selectively opened or closed to direct heated air to one or more air pockets in at least one particular area of the structure to remove and/or prevent frozen precipitation accumulation on the outer membrane.

In one alternative embodiment, the air supported structure may include an inner liner blanket that extends along a length of the outer membrane or member, such as where frozen precipitation is likely to accumulate. The inner liner blanket may extend along the medial or central portion of the structure, for example. The inner liner blanket may be coupled to the outer membrane to form a heating or frozen precipitation accumulation melting pocket between the inner liner blanket and the outer membrane. If the structure includes inner segments with at least first air pockets formed between the outer membrane and an inner liner panel, the heating pocket formed by the inner liner blanket may be in communication with at least the first air pockets. For example, the inner segments may extent to the inner liner blanket and/or the heating pocket such that at least the first air pockets are in communication with the heating pocket to receive a flow of heated air therefrom. In some embodiments, the structure may include inner segments that at least substantially surround and extend from the heating pocket (such as to the ground and/or base structure of the structure).

The inner liner blanket may be coupled to the outer membrane via baffles that are spaced along the length of the inner liner blanket and the outer membrane and extend therebetween. The baffles may extend from the outer membrane and toward the interior of the enclosure, and be coupled to an outer or exterior surface of the inner liner blanket. The baffles may include at least one aperture extending therethrough to allow air to flow through the entirety of the second air pocket. In some embodiments, the inner liner blanket may sag or form swags or festoons with the baffles (i.e., the inner liner blanket may hang in a downward curve as it extends between adjacent baffles). In this way, the inner liner blanket may form a scallop-shaped profile as it extends along the interior of the outer membrane and the baffles. At least a lower portion of the swags or sagging portions of the inner liner blanket between two or more baffles may be spaced from one or more adjacent inner segments to form an aperture therebetween in communication with the enclosure. In this way, as explained further below, heated air flowing into/through the heating air pocket may flow between the inner liner blanket and the inner segments and into the enclosure.

At least one portion of the heating air pocket formed between the inner liner blanket and the outer membrane may be coupled to one or more supply ducts that extend from inlet plenums associated with an air heating and/or blowing mechanism. For example, ends (e.g., substantially opposing ends) of the heating air pocket formed between the inner liner blanket and the outer membrane and may be coupled to one or more supply ducts. The air supported structure may thereby include supply ducts at each end or end portion of the enclosure. In some embodiments, the one or more supply ducts may be coupled to one or more apertures of a baffle. The air heating and/or blowing mechanism may be configured to force a flow of heated air through the one or more supply ducts and into the heating air pocket. The flow of heated air may then flow through the heating air pocket by flowing through the apertures in the baffles and, ultimately, into the enclosure (e.g., via the inner segments and/or directly into the enclosure).

As the heating air pocket is formed between the inner liner blanket and the outer membrane, the flow of heated air within the heating air pocket will heat the outer membrane and melt any frozen precipitation that has accumulated on the exterior surface of the outer membrane and prevent such further accumulation. The heated air flowing into the enclosure (via the inner segments and/or directly into the enclosure between the inner segments and the inner liner blanket) may act to heat the enclosure, and/or form or supplement the internal air pressure within the enclosure to maintain the outer membrane in the elevated position. The at least one heating and/or blowing mechanism may also be in communication with a return plenum that is in communication with the enclosure. The return plenum and the at least one heating and/or blowing mechanism may be configured to pull or draw the air within the enclosure into the at least one blower, and heat and exhaust the enclosure air into the at least one supply duct. In this way, at least some of the enclosure air may be heated (potentially re-heated) and blown into the heating air pocket, flow through the heating air pocket to heat the outer membrane, and then return back into the enclosure. This cycle may be repeated to heat the outer membrane (and the interior of the enclosure) to remove and prevent frozen precipitation from accumulating on the outer surface of the membrane.

In one aspect, the present disclosure provides an air supported structure forming an enclosure with internal pressurized air. The air supported structure includes an outer membrane defining an outer surface of the structure. The air supported structure also includes a plurality of inner segments formed of tab members extending from the outer membrane toward the interior of the enclosure, and at least one inner liner panel extending between adjacent tab members spaced inwardly from the outer membrane to form at least one first air pocket therebetween. The air supported structure further includes a heated air system configured to selectively direct a flow of heated air through the at least one first air pocket of at least one of the plurality of inner segments to heat the outer membrane to remove and/or prevent frozen precipitation accumulation on the outer surface thereof. The tab members include a plurality of apertures extending therethrough that allow the flow of heated air to pass between the at least one first air pockets of adjacent inner segments.

In another aspect, the present disclosure provides a method of removing and/or preventing frozen precipitation accumulation on the outer surface of air supported structure that comprises an outer membrane defining an outer surface of the structure. The method includes selectively directing a flow of heated air through a first air pocket of a first inner segment of the air supported structure to heat the outer membrane and remove and/or prevent frozen precipitation accumulation on the outer surface thereof, the air pocket of the first inner segment is formed between first and second tab members extending from the outer membrane toward the interior of the enclosure, at least one inner liner panel extending between the first and second tab members spaced inwardly from the outer membrane. The method also includes heating a second air pocket of a second inner segment of the air supported structure that is adjacent the first inner segment to heat the outer membrane and remove and/or prevent frozen precipitation accumulation on the outer surface thereof, the second air pocket of the second inner segment is formed between the first tab member, a third tab member extending from the outer membrane toward the interior of the enclosure, at least one inner liner panel extending between the first and third tab members spaced inwardly from the outer membrane, and the outer membrane. The heating the second air pocket comprising directing the flow of heated air within the first air pocket through apertures in the first tab member and into the second air pocket.

In another aspect, the present disclosure provides an air supported structure forming an enclosure with internal pressurized air. The air supported structure includes an outer membrane defining an outer surface of the structure. The air supported structure also includes an inner liner blanket coupled to the outer membrane via baffles extending from the outer membrane toward the interior of the enclosure, the inner liner blanket and outer membrane forming a heating pocket adjacent to an inner side of the outer membrane. The air supported structure further includes at least one input channel in communication with the heating pocket. The air supported structure also includes a heated air system configured to selectively direct a flow of heated through the at least one input channel and into the heating pocket to heat the outer membrane to remove and/or prevent frozen precipitation accumulation on the outer surface thereof. The baffles include a plurality of apertures extending therethrough that allow the flow of heated air to flow through the heating pocket.

In another aspect, the present disclosure provides a method of removing and/or preventing frozen precipitation accumulation on the outer surface of air supported structure that comprises an outer membrane defining an outer surface of the structure. The method includes selectively directing a flow of heated through at least one input channel of the structure and into a heating pocket formed between the outer membrane and an inner liner blanket coupled to the outer membrane via baffles extending from the outer membrane toward the interior of the enclosure to heat the outer membrane and remove and/or prevent frozen precipitation accumulation on the outer surface thereof.

In another aspect, the present disclosure provides an air supported structure forming an enclosure with internal pressurized air, the structure comprising an outer membrane with an inner side and an outer side that defines an outer surface of the structure. The structure further comprises an inner liner blanket coupled to the outer membrane via a plurality of spaced baffles extending from the outer membrane into the enclosure, the inner liner blanket and the inner surface of the outer membrane forming a heating pocket therebetween within the enclosure extending along a first portion of the outer membrane. The structure also comprises at least one input channel in communication with the heating pocket. The structure further comprises at least one heated air system configured to selectively direct a flow of heated air through the at least one input channel and into the heating pocket to heat the first portion of the outer membrane to remove and/or prevent frozen precipitation accumulation on the outer surface thereof. The baffles include a plurality of apertures extending therethrough that allow the flow of heated air to flow through the heating pocket along the first portion of the outer membrane.

In some embodiments, the plurality of baffles are spaced along a first direction, and opposing sides of the inner liner blanket extending along the first direction are spaced from the inner surface of the outer membrane to form outflow apertures therebetween for the flow of the heated air therethrough. In some such embodiments, a portion of the flow of heated air from the heating pocket through the outflow apertures flows into an interior of the enclosure to heat the interior of the enclosure. In some other such embodiments, the structure further comprises a plurality of output channels within the enclosure extending from proximate to the outflow apertures and along a second portion of the outer membrane, a first end of the plurality of output channels receiving a first portion of the flow of heated air from the heating pocket via the outflow apertures to heat the second portion of the outer membrane to remove and/or prevent frozen precipitation accumulation on the outer surface thereof. In some such embodiments, the plurality of output channels comprises a plurality of inner segments each formed of a pair of tab members extending from the outer membrane and at least one inner liner panel coupled to and extending between adjacent tab members spaced inwardly from the inner side of the outer membrane to form output channels therebetween. In some such embodiments, the tab members include apertures extending therethrough such that adjacent output channels are in communication.

In some embodiments, a second portion of the flow of heated air from the heating pocket through the outflow apertures flows into an interior of the enclosure to heat the interior of the enclosure. In some other embodiments, a second end of the plurality of output channels opposing the first end thereof is in communication with an interior of the enclosure.

In some embodiments, the inner liner blanket hangs downwardly into an interior of the enclosure between adjacent baffles. In some embodiments, a first baffle of the plurality of spaced baffles defines a first end portion of the heating pocket, and the at least one input channel is in communication with the plurality of apertures of the first baffle. In some embodiments, the at least one heated air system is configured to draw air from an interior of the enclosure via n return duct, and at least a portion of the flow of heated air comprises air drawn from the interior of the enclosure via the return duct and heated by the at least one heated air system.

In some embodiments, the first portion of the outer membrane comprises a central portion of the structure, and the second portion of the outer membrane compromise a peripheral portion of the structure extending from the central portion thereof. In some such embodiments, the central portion of the structure is the highest portion of the structure, and the peripheral portion of the structure extends downwardly from the central portion.

In some embodiments, the at least one input channel comprises a pair of input channels in communication with opposing longitudinal end portions of the heating pocket. In some such embodiments, the at least one heated air system comprises a pair of heating air systems, the pair of input channels receiving the flow of heated air from a respective heating air system of the pair of heating air systems. In some other such embodiments, lateral end portions of the heating pocket extending between the longitudinal ends are open to an interior of the enclosure. In some such embodiments, the structure further comprises a plurality of output channels within the enclosure extending from proximate to the outflow apertures and along a second portion of the outer membrane, the plurality of output channels receiving a portion of the flow of heated air from the heating pocket to heat the second portion of the outer membrane to remove and/or prevent frozen precipitation accumulation on the outer surface thereof.

In another aspect, the present disclosure provides a method of removing and/or preventing frozen precipitation accumulation on the outer surface of an air supported structure forming an enclosure with internal pressurized air. The method comprises selectively directing a flow of heated through at least one input channel and into a heating pocket formed between an inner surface of a first portion of an outer membrane of the structure and an inner liner blanket coupled to the outer membrane via baffles extending from the outer membrane to heat the outer membrane and remove and/or prevent frozen precipitation accumulation on the outer surface of the structure. The outer surface of the structure being defined by the outer membrane.

In some embodiments, the method further comprises directing the flow of heated air from the heating pocket into the enclosure. In some embodiments, the method further comprises directing the flow of heated air from the heating pocket into a plurality of output channels extending from proximate to the heating pocket and along a second portion of the outer membrane to heat the second portion of the outer membrane to remove and/or prevent frozen precipitation accumulation on the outer surface thereof.

In another aspect, the present disclosure provides an air supported structure forming an enclosure with internal pressurized air. The structure comprises an outer membrane defining an outer surface of the structure. The structure also comprises a plurality of inner segments formed of tab members extending from the outer membrane toward an interior of the enclosure, and at least one inner liner panel extending between adjacent tab members spaced inwardly from the outer membrane to form at least one first air pocket therebetween. The structure further comprises a heated air system configured to selectively direct a flow of heated air through the at least one first air pocket of at least one of the plurality of inner segments to heat the outer membrane to remove and/or prevent frozen precipitation accumulation on the outer surface thereof. The tab members include a plurality of apertures extending therethrough that allow the flow of heated air to pass between the at least one first air pockets of adjacent inner segments. In another aspect, the present disclosure provides a method of removing and/or preventing frozen precipitation accumulation on the outer surface of air supported structure that comprises an outer membrane defining an outer surface of the structure. The method comprises selectively directing a flow of heated air through a first air pocket of a first inner segment of the air supported structure to heat the outer membrane and remove and/or prevent frozen precipitation accumulation on the outer surface thereof, the air pocket of the first inner segment is formed between first and second tab members extending from the outer membrane toward an interior of the enclosure, at least one inner liner panel extending between the first and second tab members spaced inwardly from the outer membrane. The method also comprises heating a second air pocket of a second inner segment of the air supported structure that is adjacent the first inner segment to heat the outer membrane and remove and/or prevent frozen precipitation accumulation on the outer surface thereof, the second air pocket of the second inner segment is formed between the first tab member, a third tab member extending from the outer membrane toward the interior of the enclosure, at least one inner liner panel extending between the first and third tab members spaced inwardly from the outer membrane, and the outer membrane. Heating the second air pocket comprising directing the flow of heated air within the first air pocket through apertures in the first tab member and into the second air pocket.

These and other features and advantages of the present disclosure will become apparent from the following detailed description of the various aspects of the present disclosure taken in conjunction with the appended claims and the accompanying drawings.

BRIEF DESCRIPTION OF THE DRAWINGS

The present disclosure will hereinafter be described in conjunction with the following drawing figures, wherein like numerals denote like elements, and.

DETAILED DESCRIPTION OF THE INVENTION

Figure 1:
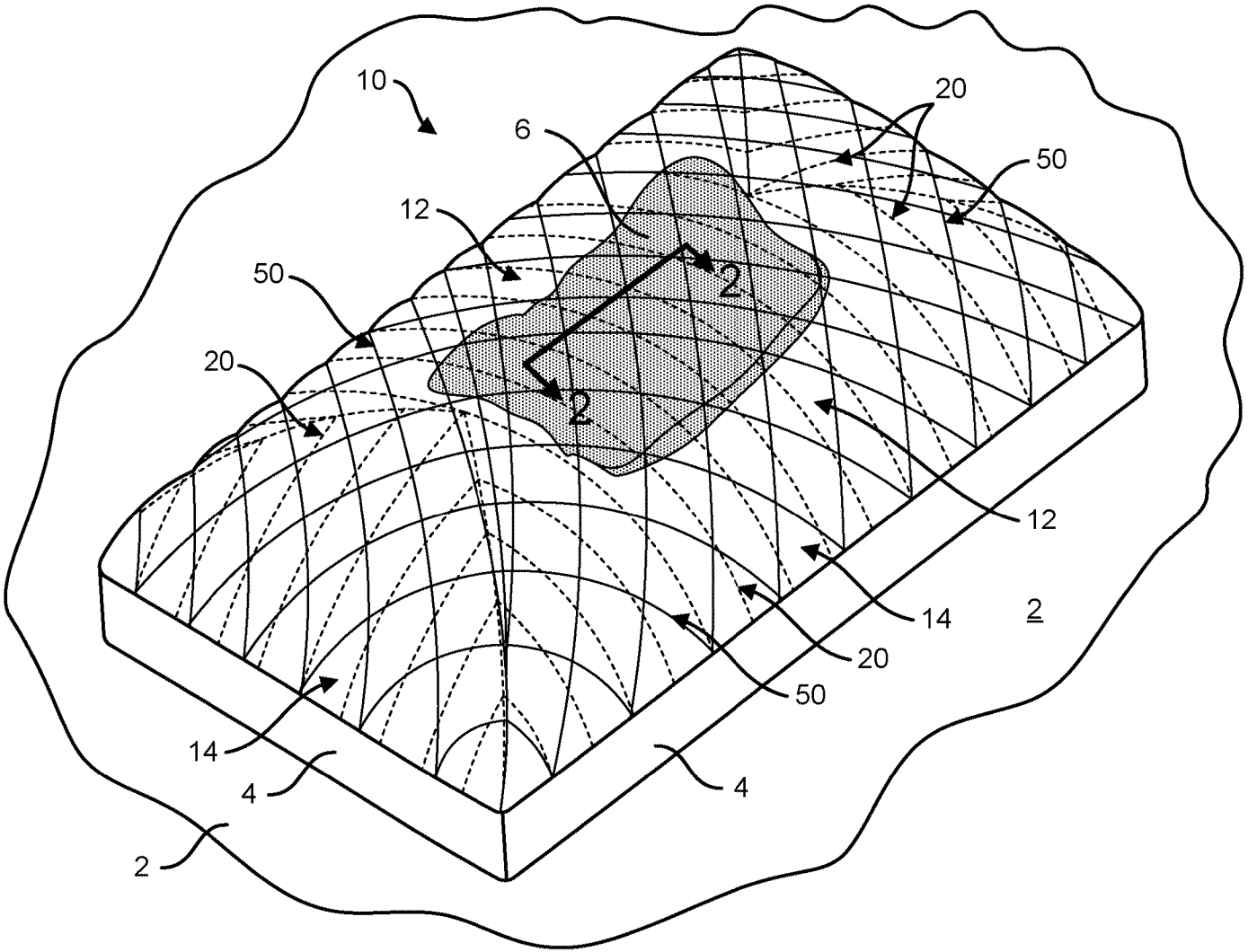
FIG. 1 is an elevational perspective view of an air supported structure with frozen precipitation accumulation thereon according to the present disclosure.

Aspects of the present disclosure and certain features, advantages, and details thereof are explained more fully below with reference to the non-limiting embodiments illustrated in the accompanying drawings. Descriptions of well-known materials, fabrication tools, processing techniques, etc., are omitted so as to not unnecessarily obscure the present disclosure in detail. It should be understood, however, that the detailed description and the specific example(s), while indicating embodiments of the present disclosure, are given by way of illustration only, and are not by way of limitation. Various substitutions, modifications, additions and/or arrangements within the spirit and/or scope of the underlying inventive concepts will be apparent to those skilled in the art from this disclosure.

The present disclosure provides improved internal hardware containment and attachment mechanisms for air supported structures, and processes of making the same, that provide secure, attractive, elevated attachment points and conduits extending therefrom and thereto for hardware within air supported structures.

The present disclosure provides improved air supported structures with frozen precipitation accumulation removal and prevention systems, and processes of making and operating same, that are automatic and more efficient than traditional frozen precipitation removal systems and methods. Further, the present disclosure provides improved air supported structures with frozen precipitation accumulation removal and prevention systems, and processes of making and operating same, that are capable of concentrating and/or maximizing removal and/or prevention to particular areas of an air supported structure.

As shown in FIGS. 1-14, present disclosure is directed to fabric-based structures or buildings 10 that are supported by pressurized air pumped into the interior of the structures 10 to form an enclosure. The structures 10 may be utilized in myriad of differing way for any use, such as for permanent or temporary industrial, military, social and recreational uses.

These structures are composed of an outer membrane, shell or skin 12 and at least one inner layer of interior panels (as explained further below). The outer membrane 12 may be formed of a plurality of panels that are coupled or sealed to each other. The structures 10 (and thereby the outer membrane 12 and the inner liner panels) may be of any size and shape.

At least the outer membrane 12 (and potentially the inner liner panels) may be anchored and sealed to the ground 2 and/or to a base structure 4 that extends to or into the ground 2, as shown in FIGS. 1, 3, 8 and 9. At least the outer membrane 12 may be substantially airtight and form a substantially airtight enclosure extending between the outer membrane 12 and the ground 2 and/or base structure 4 on which the structure 10 is erected. In some other embodiments, such as for example with fabric structures other than air supported fabric structures (e.g., frame supported fabric structures or cable supported fabric structures), the outer membrane 12 may not be substantially airtight and may not form a substantially airtight enclosure.

The air supported structure 10 may include large capacity air blowers to pump air into the interior of the structure 10 to maintain the air pressure within the structure 10 above the pressure acting on the exterior of the outer membrane 12 of the structure 10 (e.g., the local atmospheric pressure and any other applied loads). In this way, at least the outer membrane 12 of the air supported structure 10 may be maintained in tension by internal air pressure at a sufficient pressure that supports the outer membrane 12 above the ground 2 and/or base structure 4 to form the interior enclosure. For example, the blowers may replace any air which is lost from within the enclosure, such as any air that may flow through any perforations in the outer membrane 12, air which escapes when the doors or other opening of the structures 10 are opened, and air which escapes because of imperfect seals at the base of the structures 10 and about any designed openings, to maintain sufficient air pressure to maintain the interior enclosure. In some embodiments, the enclosure (e.g., formed in part by the outer membrane 12) is maintained at an inflation pressure that is sufficient to support the structure in an elevated position to form the interior enclosure. As one of ordinary skill in the art would appreciate, the necessary internal air pressure of a particular air supported structure may depend upon a number of factors, including but not limited to the weight of the structure (including components and hardware attached thereto), the external loads applied to the structure (e.g., the environmental conditions at the location of the structure), and the local air pressure at the location of the structure.

The internal air pressure within the enclosure of the air supported structure 10 formed by at least the outer membrane 12 may be sufficient to make the structure 10 substantially rigid (i.e., rigidly support the weight of the outer membrane 12 and any elements or hardware coupled thereto or otherwise supported thereby) and to resist external pressure from wind, frozen precipitation and other external loads. Although the strength of the outer membrane and the internal air pressure may be able to withstand external pressure from some amount of load from frozen precipitation accumulation on the outer surface of the membrane 12, the structure 10 may include a frozen precipitation accumulation removal and prevention configuration or system and a method to prevent excessive loads therefrom. An example of frozen precipitation accumulation 6 on the outer surface of the membrane 12 is illustrated in FIGS. 1-4 and 7, which may be melted (or prevented from occurring) by the frozen precipitation accumulation removal and prevention configuration and method of the structure 10, as explained further below. Frozen precipitation accumulation 6 may include snow, sleet, ice, slush, frost, hail or any other form of frozen or partially frozen liquid (e.g., water) or solids that adhere or collect, and build up over time, on the outer surface of the outer membrane 12 of the structure 10. Such frozen precipitation accumulation 6 may be removed from the outer surface of the outer membrane 12 of the structure 10 by raising the temperature of the frozen precipitation accumulation 6 above its melting and/or evaporating point such that is flows and/or evaporates off the outer membrane 12 of the structure 10.

It is noted that air-inflated fabric structures, which may be considered a type of frame supported fabric structures, significantly differ from air supported fabric structures. Air-inflated structures typically consist of a plurality of self-enclosed or sealed membranes that are each inflated with air to form stiff structural members that form a frame that transmits applied loads to the points of support. In this way, the inflated structural members of air-inflated structures are utilized like studs and beams of traditional construction to support a roof or ceiling of the structure. Air-inflated structures thus do not include or form an internal air pressure within the enclosure itself to maintain an outer membrane in an elevated state or position as in air supported fabric structures. Air-inflated structures thereby do not encounter the same issues associated with excess loads from the accumulation of frozen precipitation accumulation 6 on the exterior surface of the outer membrane 12 as in air supported structures 10, as shown in FIGS. 1-4 and 7.

As shown in FIG. 1, some air supported structures 10 are reinforced with a cable net 50. With cable-reinforced air-supported structures 10, the outer membrane 12 is enclosed in a cable net, as shown in FIG. 1. The outer membrane 12 distributes the load locally to the cables 50 which transfer the loads to base anchorage. It is noted that air supported structures 10 may or may not be cable reinforced.

Figure 2:
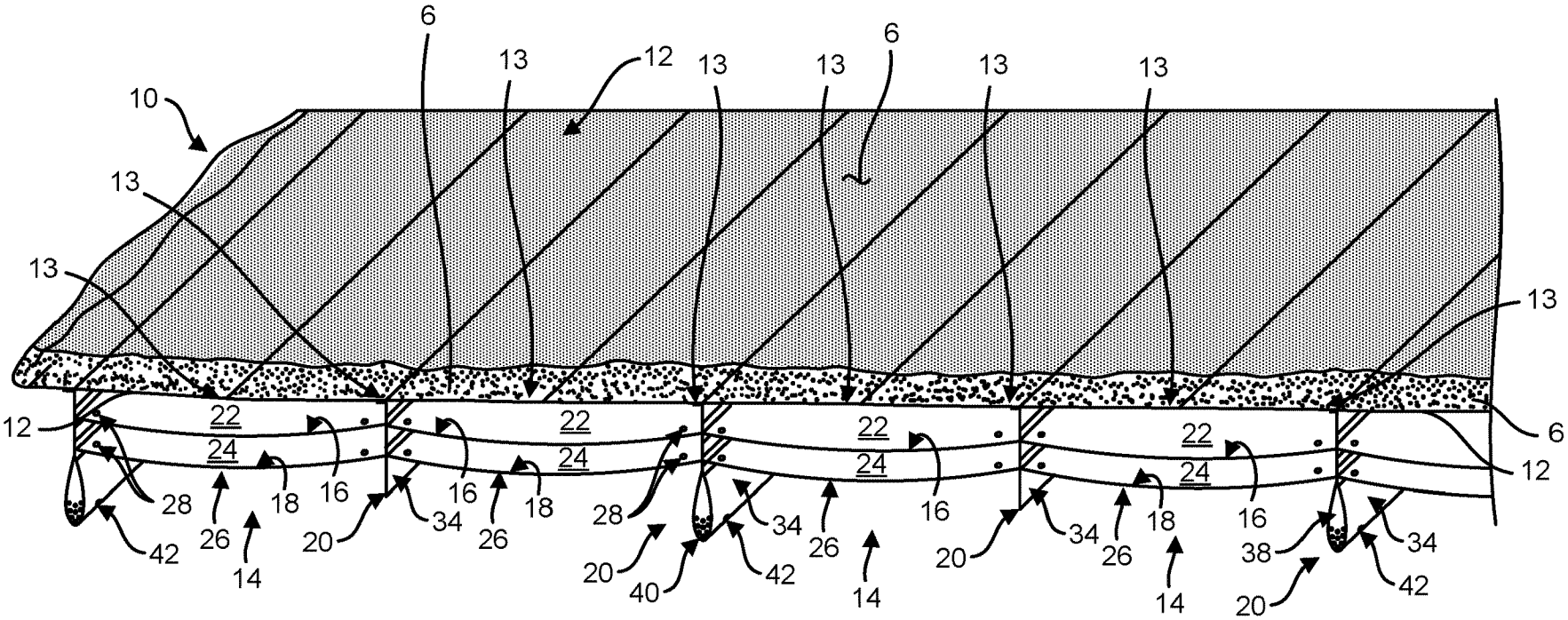
FIG. 2 is a cross-sectional view taken across the longitudinal length of the air supported structure of FIG. 1.
Figure 4:
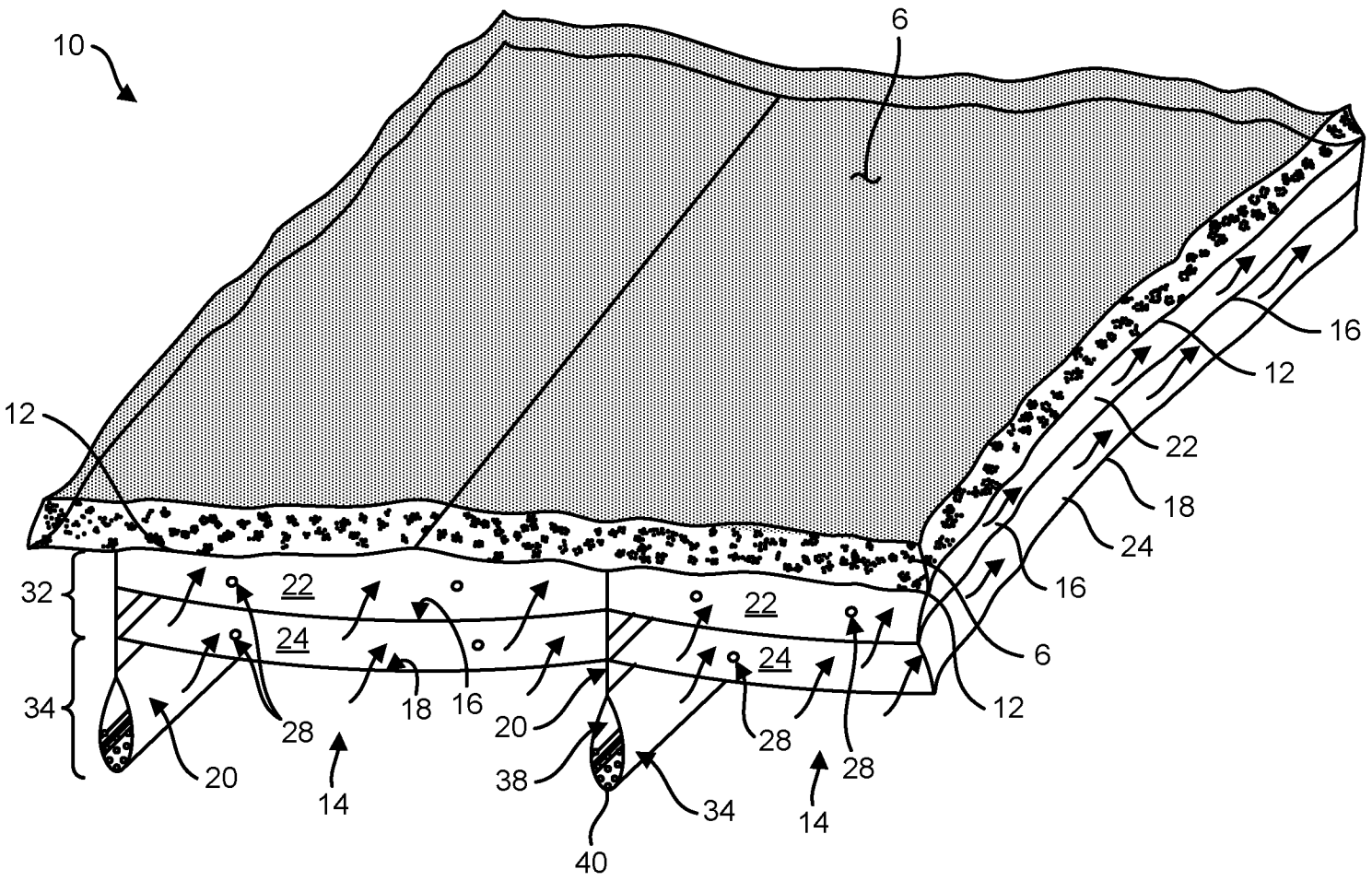
FIG. 4 is a perspective cutaway view of a portion of the air supported structure of FIG. 3.
Figure 7:
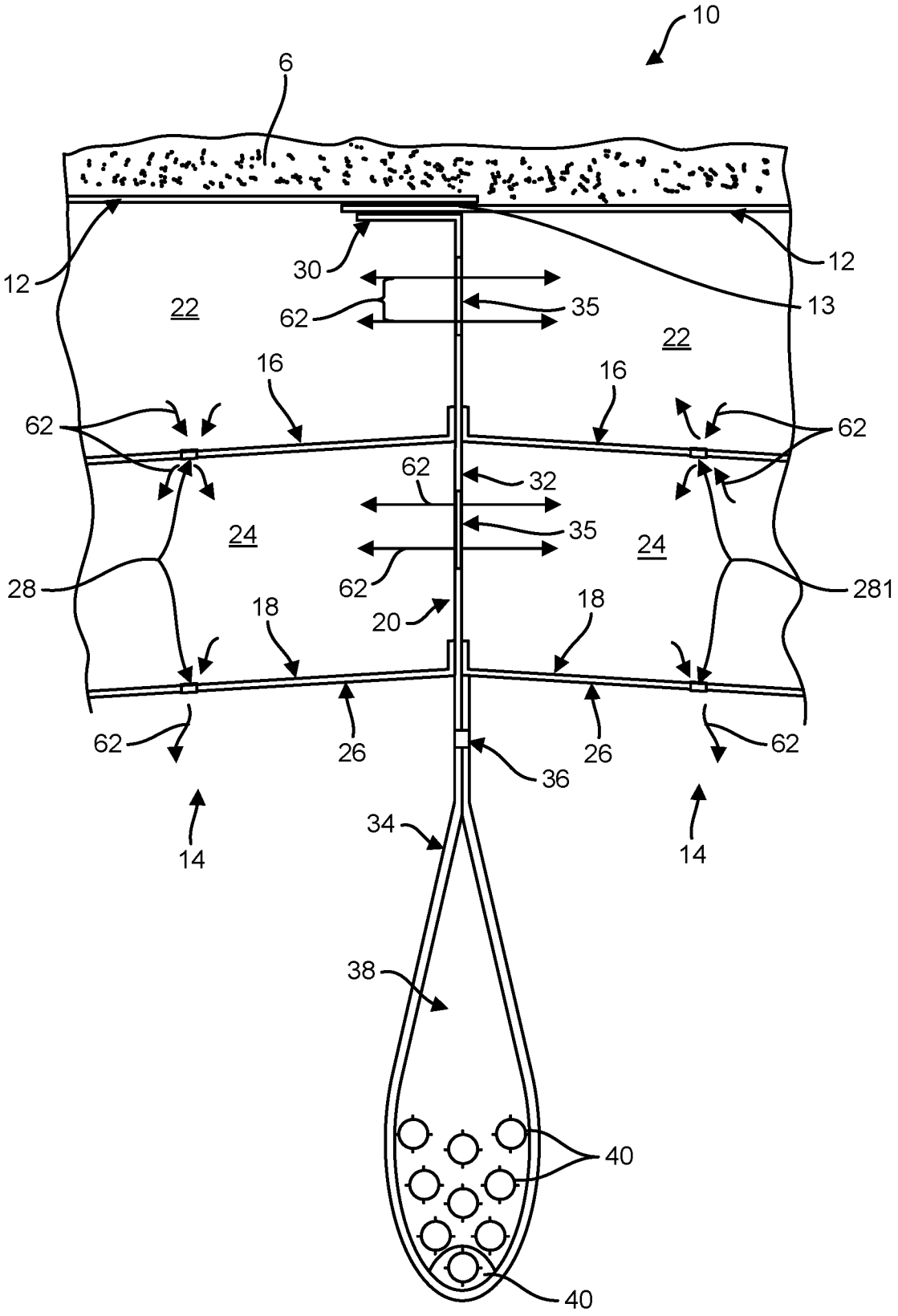
FIG. 7 is a cross-sectional view of the portion of the air supported structure of FIG. 3 illustrating the flow of heated air between adjacent inner segments.

The outer membrane 12 may be formed from any sheet-like flexible, strong material. In some embodiments, the outer membrane 12 may be formed of a fabric, a rubberized fabric, a fabric coated with plastic, or any suitable combination thereof. As shown in FIGS. 2, 4 and 7, the outer membrane 12 may be formed of a plurality of panels, with adjacent panels being coupled to each other at a seam or joint 13. In some embodiments, adjacent panels of the outer membrane 12 may be partially overlapped, and at least a portion of such overlapping portions of the adjacent panels may be joined to each other to form a substantially airtight seam, seal or joint 13. The panels forming the outer membrane 12 may be any size and shape, and may depend, at least in part, upon the desired size and shape of the fabric structure 10 formed thereby. For example, at least some of the panels forming the outer membrane 12 may be elongate such that the panels are longer along a width or lateral direction than a length or longitudinal direction. At least some other panels forming the outer membrane 12 may be elongate such that the panels are longer along the length or longitudinal direction than the width or lateral direction. Adjacent panels may be joined or sealed 13 along or proximate to the entirety of their respective adjacent and overlapped edges to form the substantially airtight outer membrane 12.

As shown in FIGS. 2-13, the structure 10 may include one or more layers of sheet-like flexible internal liners positioned interior of the main outer membrane 12. The inner surface of the inner-most internal liner may form an interior surface of the structure 10. These internal liners may be formed of inner liner panels that are attached to each other and suspended from the outer membrane 12 to define at least one first air pocket or space between the internal liners and the outer membrane 12. When two or more inner liners are utilized, at least one additional or second air pocket 24 is formed between the inner liners themselves. The first air pocket 22 (and potentially second air pocket 24) act as one or more thermal barrier that insulates the enclosure of the structure 10.

As shown in FIGS. 2-13, the fabric structure 10 may include a plurality of inner segments 14 including at least one inner liner panel 16, 18 extending between a pair of tab members 20 that extend from and are coupled to the main outer membrane 12. The structure 10 may include a plurality of the inner segments 14 positioned interior of the outer membrane 12 such that at least a substantial portion of the outer membrane 12 includes the inner segments 14. Adjacent inner segments 14 may be formed on opposing sides of a common tab, as shown in FIGS. 2, 4, 5 and 7. In some embodiments the entirety of the outer membrane 12 may include inner segments 14. In this way, the envelope of the fabric structures 10 may be formed by the outer membrane 12 and the plurality of inner segments 14 coupled thereto. At least some of the segments 14 may extend along the entirety of a dimension of the fabric structure 10, as shown in FIG. 1. For example, the structure 10 may include inner segments 14 that extend across or along the entirety of the lateral width of the structure 10, as shown in FIG. 1. As also shown in FIG. 1, some of the segments 14 may extend along only a portion of a dimension of the structures, such as only partially along a longitudinal length of the structure 10.

Figure 3:
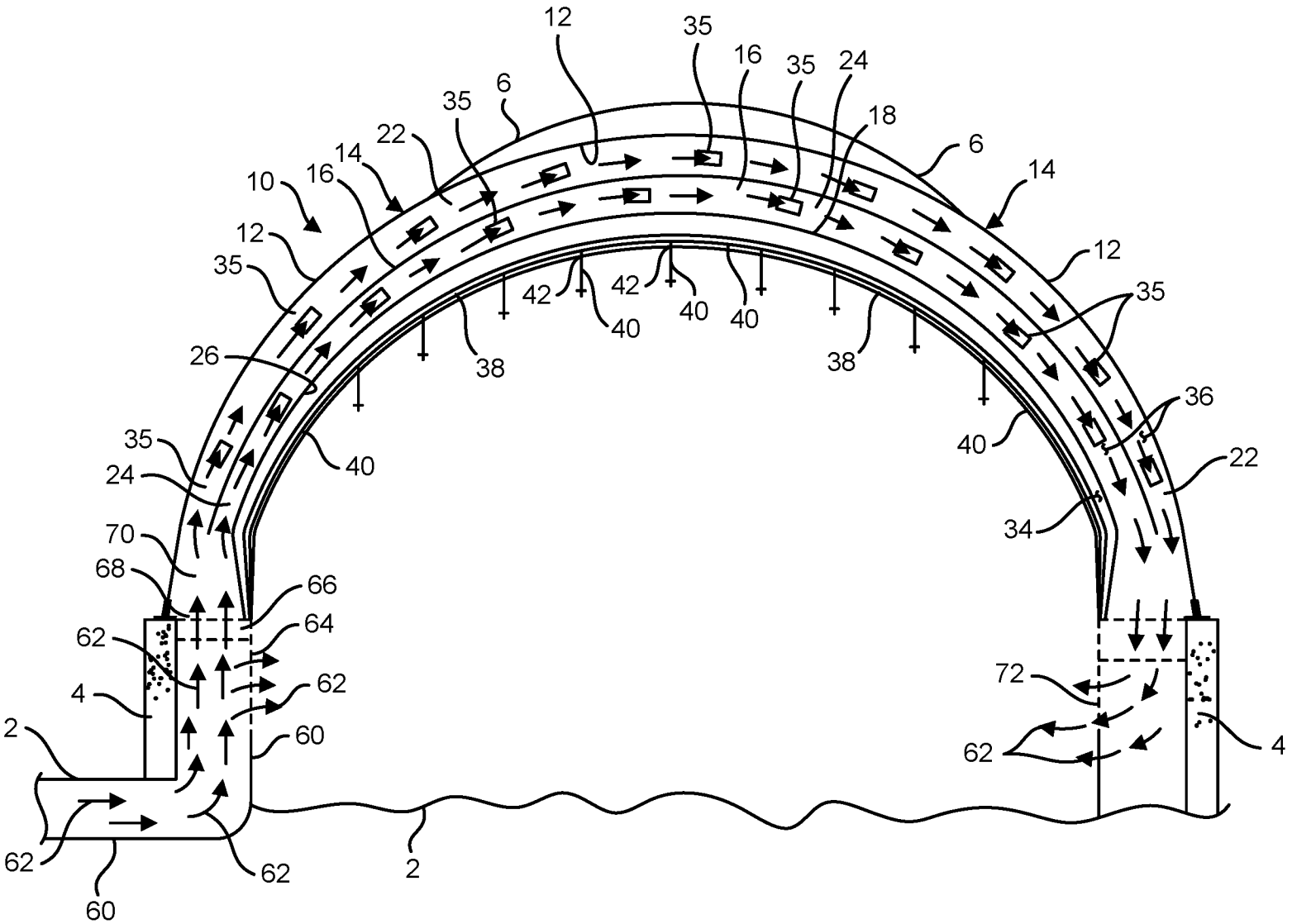
FIG. 3 is a cross-sectional view taken across the lateral width length of the air supported structure of FIG. 1 illustrating a flow of heated air therethrough during a snow melting mode thereof.

As shown in FIGS. 2-7, in some embodiments the inner segments 14 of the fabric structure 10 may each include a first inner liner panel 16 and a second inner liner panel 18. However, the inner segments 14 may include only one inner liner panel (i.e., the first inner liner panel 16), the first and second inner liner panels 16, 18, or three or more inner liner panels. Further, differing inner segments 14 may include a different quantity and/or arrangement of inner liner panels. As shown in FIGS. 2-7, the first inner liner panel 16 of one or more segments 14 of the fabric structure 10 may be positioned inwardly of the outer membrane 12 toward the interior of the enclosure (and generally towards the ground, particularly at the top portion of the enclosure). In this way, the first inner liner panel 16 and the outer membrane 12 may form a first air pocket or space 22 that extends between an interiorly-facing surface of the outer membrane 12 and an outwardly-facing surface of the first inner liner panel 16, as shown in FIGS. 2, 3, 7 and 8. Similarly, as shown in FIGS. 2-7 the second inner liner panel 18 of one or more segments 14 of the fabric structure 10 may be positioned inwardly of the first inner liner panel 16 toward the interior of the enclosure (and generally towards the ground, particularly at the top portion of the enclosure). In this way, the second inner liner panel 18 and the first inner liner panel 16 may form a second air pocket or space 24 that extends between an interiorly-facing surface of the first inner liner panel 16 and an outwardly-facing surface of the second inner liner panel 18, as shown in FIGS. 2-7. An inwardly facing-surface 26 of the second inner liner panel 18 (or the inner-most inner liner panel) may define an inner surface of the structure 10, which may define (in part) the enclosure, as shown in FIG. 3. In this way, as shown in FIG. 2, an inwardly facing-surface 26 of the second inner liner panel 18 (or the inner-most inner liner panel) may further define at least a portion of the ceiling and/or side walls of enclosure.

As shown in FIGS. 2, 4, 5 and 7, the first inner liner panel 16 and/or second inner liner panel 18 (and any other inner liner panel) of each inner segment 14 may include at least one through aperture 28 extending therethrough from the outwardly-facing surface to the interiorly-facing surface thereof. The first air pocket 22 of the inner segments 14 may thereby be in fluid or air communication with the second air pocket 24, and the second air pocket 24 of the inner segments 14 may thereby be in fluid or air communication with the enclosure of the structure 10. The at least one through aperture 28 of the second inner liner panel 18 may thereby allow air to flow therethrough from the enclosure to the second air pocket 24, and the at least one through aperture 28 of the first inner liner panel 16 may thereby allow air to flow therethrough from the second air pocket 24 to the first air pocket 22. The at least one through apertures 28 of the first and second inner liner panels 16, 18 of each inner segment 14 may thereby allow the first and second air pockets 22, 24 to form as the enclosure is erected, such as during inflation of the structure.

The at least one through aperture 28 of the inner liner panels 16, 18 may thereby allow air to flow therethrough from within the enclosure and to the interior or interiorly-facing surface of the outer membrane 12. In this way, if the structure 10 is an air supported structure, the air pressure created within the enclosure of the structure 10 via blowers or other mechanisms is able to extend through the inner liner panels 16, 18 and to the interior or interiorly-facing surface of the outer membrane 12 via the at least one through apertures 28 to exert an outwardly directed force or pressure thereon and form the enclosure (i.e., tension the outer membrane 12). Further, as the at least one through apertures 28 allow the pressure to equalize across the enclosure, the second air pocket 24 and the first air pocket 22, the first and second inner liner panels 16, 18 of each inner segment 14 are able to hang or suspend freely between the tab members 20 thereof, as shown in FIGS. 2, 4, 5 and 7.

The first inner liner panel 16 and/or second inner liner panel 18 may be similar to the panels forming the outer membrane 12. For example, the first inner liner panel 16 and/or second inner liner panel 18 may be made from the same or similar material as that of the outer membrane 12. In some embodiments, the inner liner panel 16 and/or second inner liner panel 18 may be formed from a relatively thinner and/or lighter fabric material than fabric forming the outer membrane 12. The tab members 20 may be substantially similar to the panels forming the outer membrane 12, the first inner liner panel 16 and/or second inner liner panel 18. For example, the tab members 20 may be made from the same or substantially similar materials as that of the outer membrane 12, the first inner liner panel 16 and/or second inner liner panel 18. The outer membrane 12, the first inner liner panel 16, the second inner liner panel 18 and the tab members 20 (or a combination thereof) may be configured such that they can be heat welded to each other. Each first inner liner panel 16, second inner liner panel 18 and/or tab member 20 may be a single unitary piece or component (i.e., may be of one-piece construction, monolithic or integral).

As shown in FIG. 7, one or more of the tab members 20 may extend from the outer membrane 12, such as the interior or interiorly-facing surface of the outer membrane 12. For example, an end portion 30 of the tab member 20 may overlap a portion the outer membrane 12 along the interior surface thereof, as shown in FIG. 7. In some other embodiments, the end portion 30 of at least some of the tab members 20 may be affixed to the outer/exterior or outwardly-facing surface of the outer membrane 12 rather than the interior surface as depicted in FIG. 7.

As also shown in FIG. 7, the tab members 20 may include a body portion 32 that extends from the end portion 30. The body portion 32 of the tab members 20 may extend away from an interior surface of the outer membrane 12 and the end portion 30 extends inwardly towards the interior of the enclosure and/or downwardly towards the ground (e.g., depending upon the particular position of a respective portion of the tab member 20). As noted above, the tab members 20 may also extend laterally along or across the width or longitudinally across or along the length (or a combination thereof) of the fabric structure 10, depending upon the orientation or design (e.g., shape) of the structure 10. In this way, the body portion 32 (and the end portion 30) of the tab members 20 may extend inwardly from the interior surface of the outer membrane 12 and laterally along or across the width or longitudinally across or along the length (or a combination thereof) of the fabric structure 10.

Figure 5:
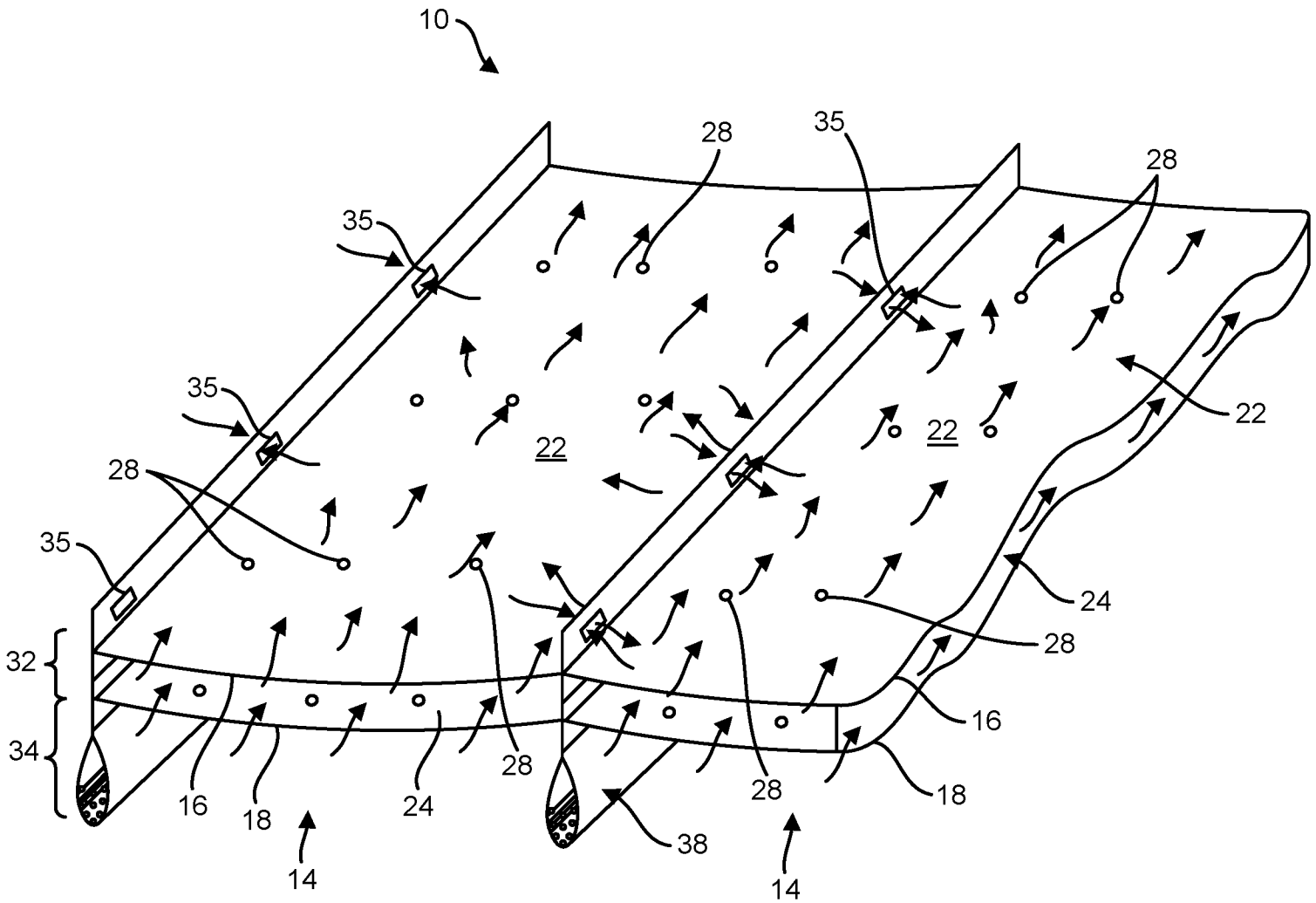
FIG. 5 is a perspective cutaway view of the portion of the air supported structure of FIG. 3 illustrating the flow of heated air through and between adjacent inner segments thereof.

With reference to FIG. 7, a first end portion of a first liner panel 16 of an inner segment 14 may overlap and be coupled to a first side or face of the body portion 32 of the tab member 20 of an inner segment 14. The overlapped portion of the first end portion of the first liner panel 16 may extend substantially parallel to the corresponding portion of the body portion 32 of tab member 20. The first end portion of the first liner panel 16 may be coupled to the first side of the body portion 32 of the tab member 20 such that the free or non-coupled portion of the first liner panel 16 that extends away from the tab member 20 to an adjacent tab member 20 (see FIGS. 2, 4 and 5) is spaced inwardly from the outer membrane 12. A second end portion of the first liner panel 16 of the inner segment 14 that opposes the first end portion thereof may be coupled to the adjacent tab member 20 in a substantially similar way as the first end portion, as shown in FIGS. 2, 4 and 5, except that the opposing second end portion of the first liner panel 16 is coupled to a second side or face of the adjacent tab member 20 that substantially opposes the first face thereof. In this way, the position of the coupling between the first and second end portion of the first liner panel 16 to the first and second faces of the body portion 32 of the adjacent tab members 20, respectively, may define the shape and/or thickness of the first air pocket 22 in a direction extending from the outer member 20 toward the interior of the enclosure. In some embodiments, the portions of the first and second end portions of the first liner panel 16 that overlap and are coupled to the first and second sides of the tab members 20, respectively, may extend from adjacent or proximate to the outer membrane 12 to a respective interior portion of the tab member 20.

As also shown FIG. 7, the body portion 32 of the tab members 20 may extend past the first inner liner members 16 coupled thereto further towards the interior of the enclosure. A first end portion of a second inner liner panel 18 may thereby overlap and be coupled to the first face of the body portion 32 of the tab member 20 below or inwardly of an adjacent first inner liner member 16, as shown in FIGS. 2, 4, 5 and 7. The overlapped portion of the first end portion of the second inner liner panel 18 may extend substantially parallel to the corresponding portion of the body portion 32 of tab member 20. The first end portion of the second liner panel 18 may be coupled to the first side of the body portion 32 of the tab member 20 such that the free or non-coupled portion of the second inner liner panel 18 that extends away from the tab member 20 to an adjacent tab member 20 (see FIGS. 2, 4 and 5,) is inwardly spaced from the first liner panel 16. A second end portion of the second liner panel 18 of the inner segment 14 that opposes the first end portion thereof may be coupled to the adjacent tab member 20 in a substantially similar way as the first end portion, as shown in FIGS. 2, 4 and 5, except that the opposing second end portion of the second inner liner panel 18 is coupled to the second face of the adjacent tab member 20. In this way, the position of the coupling between the first and second end portions of the second inner liner panel 18 to the first and second faces of the body portion 32 of the tab members 20, respectively, of an inner segment 14 may define the shape and/or thickness of the second pocket 24 in a direction extending from the first liner panel 16 toward the interior of the enclosure. In some embodiments, the portions of the first and second end portions of the second inner liner panel 18 that overlap and are coupled to the first and second sides of the tab members 20, respectively, may be spaced inwardly from the first liner panel 16.

The overlapped and coupled portions of the first and/or second end portions of the first liner panels 16 and their respective tab members 20, and/or the overlapped and coupled portions of the first and/or second end portions of the second inner liner panels 18 and their respective tab members 20, may be coupled together. For example, the overlapped portions may be heat welded or sealed together. However, the overlapped portions may be coupled or affixed to each other via any other process, such as being sowed, riveted, clamped or otherwise coupled together (e.g., in addition to, or instead of, heat welding).

Figure 6:
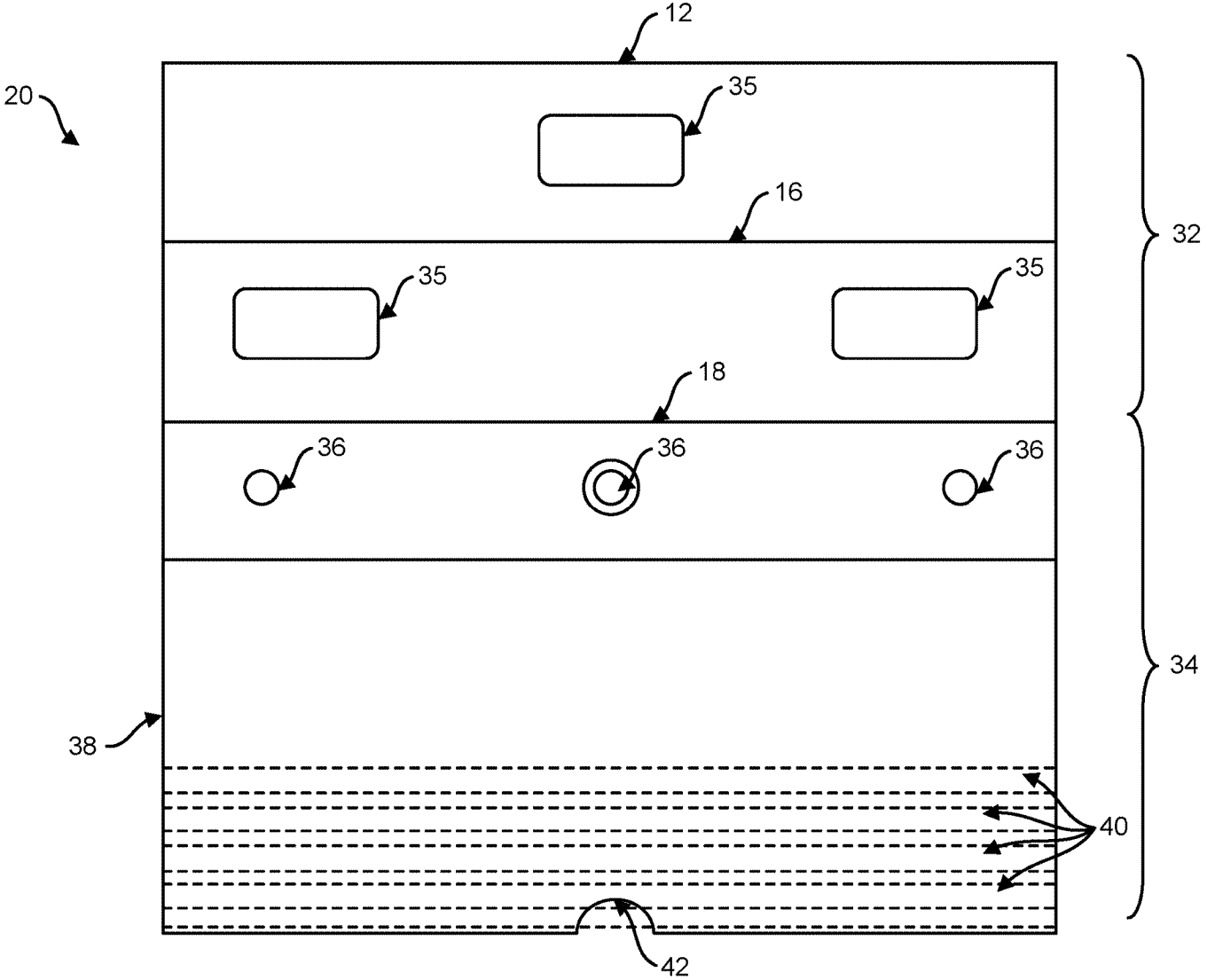
FIG. 6 is a cross-sectional view of a portion of the air supported structure of FIG. 3 illustrating a tab member thereof.

As shown in FIGS. 3, 6 and 7, the body portion 32 of one or more of the tab members 20 may include at least one through aperture 35 extending therethrough that couples adjacent inner segments 14 in fluid or air communication. In some embodiments, a plurality of consecutive segments 14 (such as segments 14 of the same orientation) may be in air communication via the at least one through aperture 35 of the body portion 32 of the tab members 20. The at least one through aperture 35 of the body portion 32 of the tab members 20 may extend through the body portion 32 from the first face to the second face thereof. The at least one through aperture 35 of the body portion 32 may also extend through the portions of the first and/or second inner liner panels 16, 18 coupled thereto. The at least one through aperture 35 of the body portion the portion 32 may be configured to allow air to flow between adjacent first air pockets 22 and/or second air pockets 24 of adjacent inner segments 14, as shown in FIGS. 3, 6 and 7. For example, a tab member 20 may include a first through aperture 35 that extends through the body portion 32 (and potentially portions of first inner liners 16 overlapped and coupled thereto) between a pair of adjacent first air pockets 22 to allow air to flow therebetween. Similarly, a tab member 20 may include a second through aperture 35 that extends through the body portion 32 (and potentially portions of second inner liners 18 (and/or first inner liners 16) overlapped and coupled thereto) between a pair of adjacent second air pockets 24 to allow air to flow therebetween. In some embodiments, one or more of the tab members 20 may include a plurality of through apertures 35 spaced along the length thereof (e.g., extending along a lateral and/or longitudinal dimension of the structure 10) that extend through the body portion 32 thereof (and potentially first and/or second inner liners 16, 18 coupled thereto) to couple adjacent inner segments 14 (e.g., couple first pockets 22 and/or second pockets 24) in air communication along their lengths, as shown in FIGS. 3 and 5.

The at least one through aperture 35 may allow air to flow between adjacent inner segments 14, such as between first pockets 22 and/or second pockets 24 thereof, to aid or facilitate air flow between the inner segments 14 (such as between first pockets 22 and/or second pockets 24 thereof), such as during heating and/or cooling of the outer member 12. For example, as discussed further below, the at least one through aperture 35 may allow heated air to flow between adjacent inner segments 14, such as between first pockets 22 and/or second pockets 24 thereof, to aid or facilitate air flow between the inner segments 14 (such as between first pockets 22 and/or second pockets 24 thereof) during heating of the outer member 12 in a frozen precipitation accumulation removal and prevention mode of the structure 10. As another example, the at least one through aperture 35 may allow air to flow between adjacent inner segments 14, such as between first pockets 22 and/or second pockets 24 thereof, to aid or facilitate air flow between the inner segments 14 (such as between first pockets 22 and/or second pockets 24 thereof) during erection and/or take down of the structure 10.

As shown in FIG. 6, the body portion 32 of the tab members 20 may extend along the entirety of the length of the tab members 20. In other embodiments, however, the body portion 32 of the tab members 20 may extend along only a portion of the length of the tab members 20. As noted above, the tab members 20, and thereby, the body portion 32 thereof, may extend along a dimension (e.g., lateral width or longitudinal length) of the structure 10, such as across at least a portion of the width and/or length of the structure 10. The thickness of the first air pockets 22 and/or second air pockets 24 may vary depending upon the position or location of the first and second inner liner panels 16, 18, respectively, on the body portion 32 of the tab members 20.

As shown in FIG. 3, in some embodiments the apex or central portion of inner segments 14 that extend across the width of a structure 10 may include the thickest first air pockets 22 and/or second air pockets 24.

At least one tab member 20 of the structure 10 may include an attachment portion 34 extending from the body portion 32, as shown in FIGS. 2, 3 and 6-8. The attachment portion 34 of the tab member 20 may thereby extend past the interior surface 26 of the second liner panel 18 (or the inner-most panel) and into the enclosure. The attachment portion 34 may thereby be positioned proximate to the interior surface 26 of the second inner liner panel 18 or the inner-most liner panel (i.e., the interior walls or surfaces defining the enclosure). The attachment portion 34 may extend inwardly toward the interior of the enclosure from the body portion 32 of the tab member 20, as shown in FIGS. 2-7. The attachment portion 34 of the tab members 20 may thereby extend past the interior surfaces of the inner-most inner liner panel 18 towards the interior of the enclosure and/or downwardly towards the ground. It is noted that at least some of the tab members 20 (or all of the tab members 20) of the structure 10 may not include or form the at least one attachment portion 34.

The attachment portion 34 of the tab member 20, which is positioned within the enclosure proximate to the interior surface of the second liner panel 18 or the inner-most panel, may include or define at least one hardware attachment point, such as at least one aperture 36 and/or at least one conduit portion 38 defining a cavity through which hardware 40 may extend or be carried therein. For example, the at least one aperture 36 of the attachment portion 34 of the tab members 20 may be configured to allow hardware to pass therethrough and, thereby, be supported by the tab members 20. In some embodiments, the attachment portion 34 of the tab members 20 (and/or the body portion 32 thereof) may be a netting or other substantially open configuration that forms a plurality of apertures 36. The at least one aperture 36 of the attachment portion 34 of the tab members 20 may be utilized as at least one hardware attachment mechanism or hanging point for any hardware that may be utilized with the structure 10. As the at least one aperture 36 of the tab members 20 is positioned within the enclosure of the structure 10, the at least one aperture 36 can be utilized to attach hardware of any type or purpose proximate to the interior surface 26 of the enclosure.

The at least one conduit portion 38 may also serve as at least one hardware attachment mechanism or point. In some embodiments, at least one of the tab members 20 of the structure 10 may include both the at least one conduit portion 38 and the at least one aperture 36 to provide differing hardware attachment mechanisms or points (which may be better suited for differing types of hardware 40 or applications). The at least one conduit portion 38 may be an elongated raceway, conduit, channel, tube, cavity, passage or aperture that extends along the length of the tab member 20, as shown in FIGS. 2-7. The at least conduit portion 38 may hide or at least obscure hardware 40 positioned therein viewed from within the enclosure. Further, the at least conduit portion 38 may also gather, bundle or group together a plurality of hardware 40 positioned therein, as shown in FIG. 7. As shown in FIGS. 2, 3, 6 and 7, the at least one conduit portion 38 of one or more tab members 20 of the structure 10 may include at least one aperture 42 extending therethrough. The at least one aperture 42 may thereby extend from the enclosure into the interior of the conduit portion 38. The at least one aperture 42 may be in communication with the at least one conduit portion 38 such that elongate hardware 40 housed within the conduit portion 38 can extend into the enclosure via the at least one aperture 42, as shown in FIG. 3. As also shown in as shown in FIG. 3, the hardware 40 may extend into the enclosure from the conduit portion 38 via a respective aperture 42 and be at least partially physically supported by at least one fixation aperture 36 of the attachment portion 34 of the tab member 20. In this way, for example, the attachment portion 34 of the tab member 20 may provide at least the primary physical support for a particular hardware mechanism 40, while the conduit portion 38 may house and support additional hardware that couples or extends to the particular hardware mechanism 40.

FIGS. 3-13 illustrate exemplary frozen precipitation accumulation removal and prevention configurations or systems, and related frozen precipitation accumulation removal and prevention methods, of the air supported structure 10. As shown in FIGS. 3-13, the structure 10 includes a heated air handling system that directs heated air through the inner segments 14 to heat the outer membrane 10 and, thereby, remove (e.g., melt) and prevent the accumulation of frozen precipitation on the exterior of the outer membrane 12.

Figure 8:
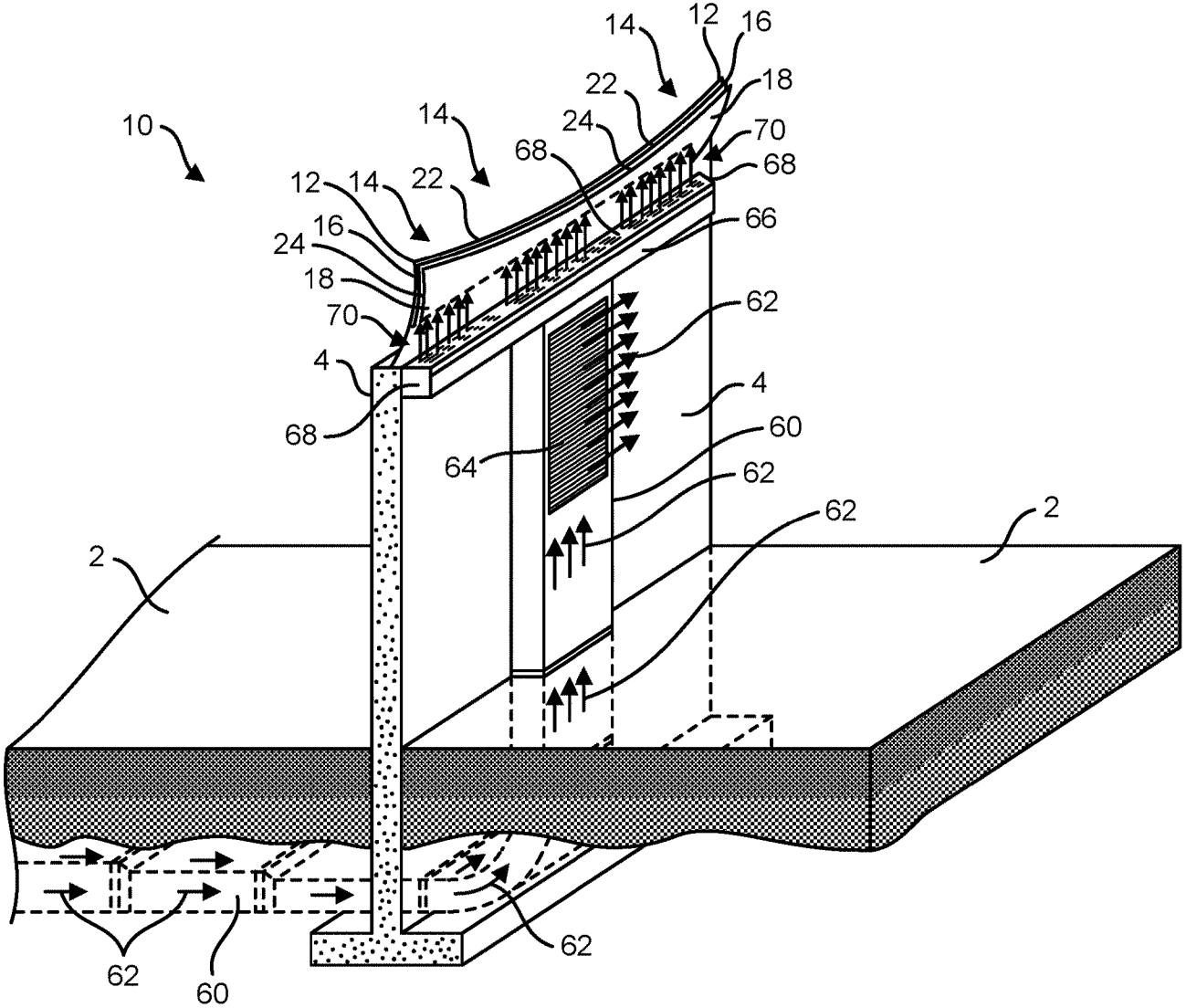
FIG. 8 is a perspective cutaway view of a portion of the air supported structure of FIG. 3 illustrating a supply of heated air to the structure and enclosure.
Figure 9:
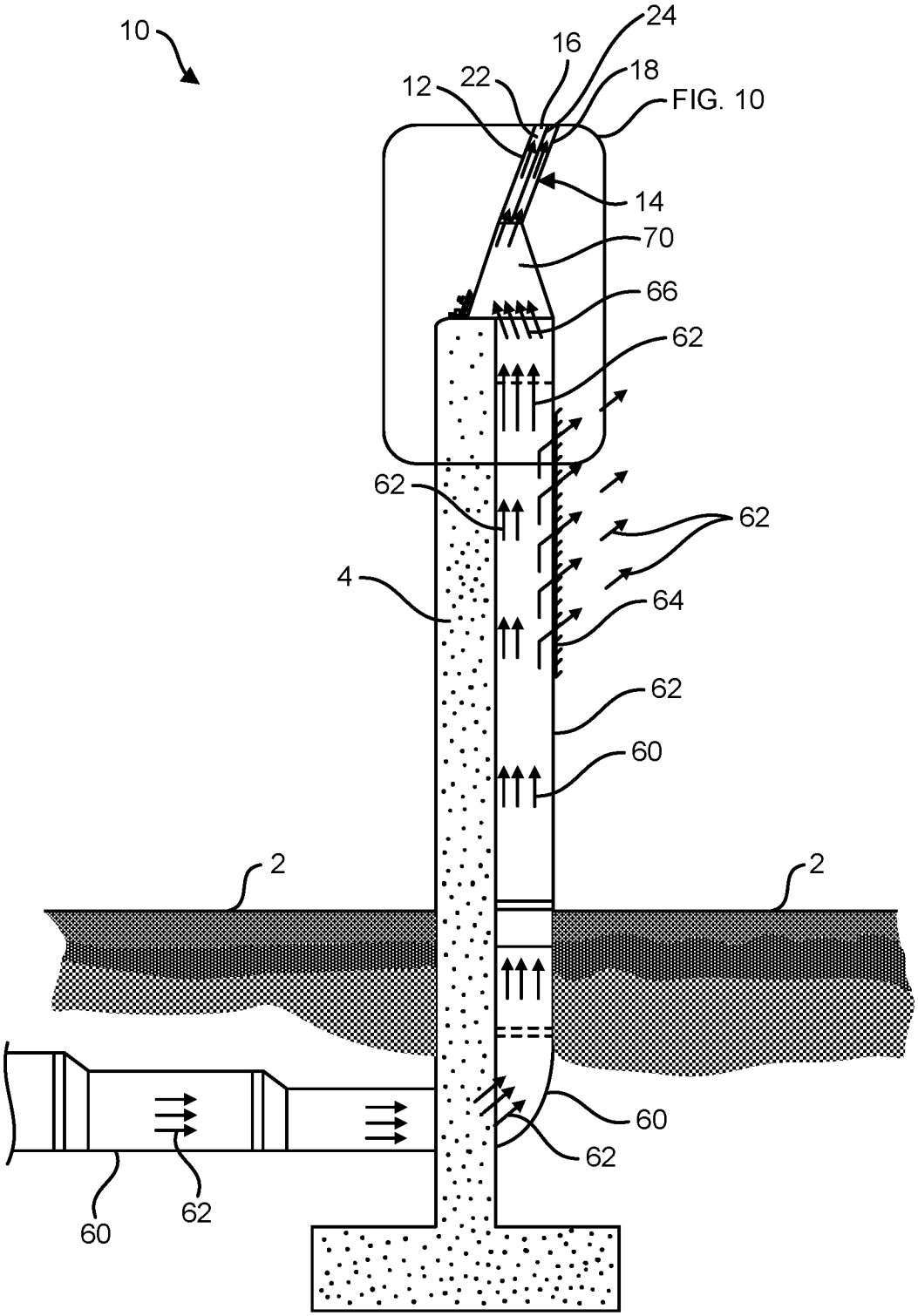
FIG. 9 is a cross-sectional view of a portion of the air supported structure of FIG. 3 illustrating the heated air supply of FIG. 7.

As shown in FIGS. 3, 8 and 9, the air supported structure 10 may include at least one inlet plenum, duct or passageway 60 that may extend into the enclosure. In some embodiments, the structure 10 may include a plurality of inlet plenums 60 spaced about the perimeter of the enclosure. For example, the structure 10 may include a plurality of inlet plenums 60 spaced along a side of the enclosure, such as along a longitudinal side thereof. The at least one inlet plenum 60 may define a passageway for the flow of heated air 62 therethrough, as shown in FIGS. 3, 8 and 9. The at least one inlet plenum 60 may extend from at least one blower and/or heating mechanism configured to selectively create the flow of heated air 62 therethrough. It is noted that any heating and air moving mechanism(s) may be utilized to selectively create or produce the flow of heated air 62 therethrough. It is also noted that the shape, size and number of the inlet plenums 60 may vary depending upon the particular frozen precipitation removal and prevention needs of a particular structure 10. The temperature, humidity, flow rate and any other characteristic of the flow of heated air 62 may vary, and may be related to the configuration and/or the particular frozen precipitation removal and prevention needs of a particular structure 10.

As also shown in FIGS. 3, 8 and 9, the at least one inlet plenum 60 may extend from exterior of the structure 10 and into the enclosure. For example, the at least one inlet plenum 60 may extend under or through the ground 2 from outside the structure 10 to inside the enclosure. The at least one inlet plenum 60 may up and out of the ground 2 within the enclosure, as shown in FIGS. 3, 8 and 9. In addition to, or instead of, extending through the ground 2, the at least one inlet plenum 60 may extend through the support base 4 of the structure 10 from outside the structure 10 to inside the enclosure, as shown in FIGS. 3, 8 and 9. For example, the at least one inlet plenum 60 may extend through a foundation and/or side wall of the base structure 4 from which at least the outer membrane 12 extends, as shown in FIGS. 3, 8 and 9.

The at least one inlet plenum 60 may extend within the enclosure of the structure 10. As shown in FIGS. 3, 8 and 9, in some embodiments the at least one inlet plenum 60 may extend upwardly into the enclosure, such as along or proximate to the interior surface of the base structure 4. As shown in FIGS. 3 and 8-10, the at least one inlet plenum 60 may include at least one vent 64 configured to direct or allow a portion of the flow of heated air 62 into the enclosure to warm the enclosure. The flow of heated air 62 into the enclosure via the at least one vent 64 may heat the enclosure to form a desired or comfortable atmosphere or temperature within the and/or to heat the outer membrane 12 to prevent and/or melt frozen precipitation accumulation on the exterior thereof. The at least one vent 64 may be selectively opened and closed (potentially incrementally) to selectively allow the flow of heated air 62 into the enclosure to heat enclosure. For example, the at least one vent 64 may controlled manually or by a thermostat to selectively heat the enclosure via the flow of heated air 62. In some other embodiments, the at least one vent 64 may be fixedly open to allow a portion of the flow of heated air 62 to flow into the enclosure.

As shown in FIGS. 3 and 8-11, the at least one inlet plenum 60 may extend to or otherwise be in communication with at least one distribution plenum, channel, duct or passageway 66 such that the flow of heated air 62 extends thereto. The at least one distribution plenum 66 may be configured to direct or distribute the flow of heated air 62 into at least one inner segment 14 of the structure 10. The at least one distribution plenum 66 may be communication with the at least one inlet plenum 60 and may include at least one aperture or vent 68 configured to output the flow of heated air 62 into the at least one inner segment 14 of the structure 10. In some embodiments, the at least one vent 68 of the at least one distribution plenum 66 may be selectively openable and closable (potentially incrementally) to selectively allow the flow of heated air 62 into at least one inner segment 14. In other embodiments, the at least one vent 68 of the at least one distribution plenum 66 may fixedly open to allow the flow of heated air 62 to flow into at least one inner segment 14.

Figure 11:
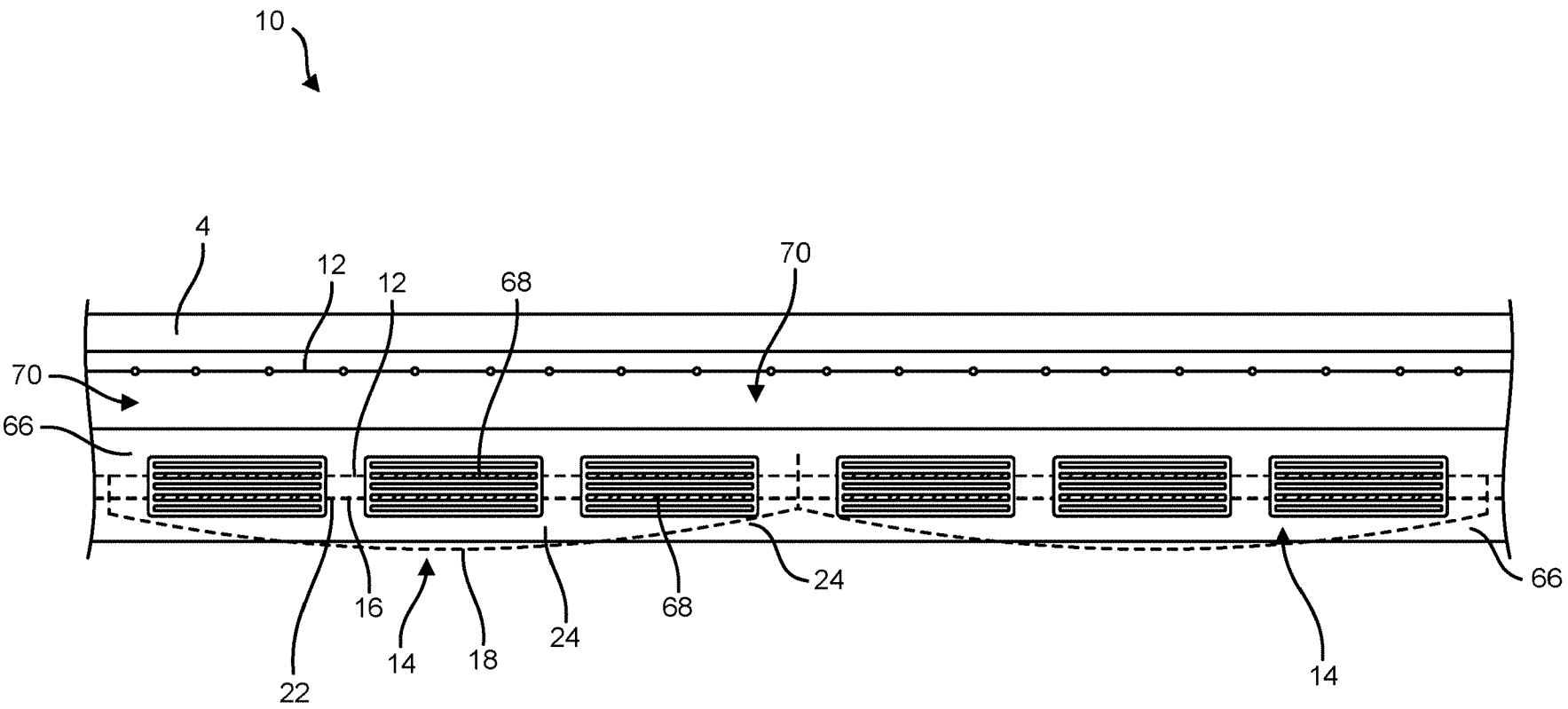
FIG. 11 is a top view of a portion of the air supported structure of FIG. 3 illustrating an exemplary heat air distribution channel thereof.

In some embodiments, the at least one distribution plenum 66 may be configured to distribute the flow of heated air 62 into a plurality of inner segments 14. For example, the at least one distribution plenum 66 may be elongated or extend along a portion of the structure such that the at least one distribution plenum 66 extends along or proximate to ends of a plurality of inner segments 14, as shown in FIGS. 8 and 11. In some such embodiments, the at least one distribution plenum 66 may include a plurality of vents 68 positioned along its length configured to distribute the flow of heated air 62 into the plurality of inner segments 14, as shown in FIGS. 8 and 11. In some embodiments, the structure 10 may include a plurality of inlet plenums 60 and distribution plenums 66 each configured to distribute the flow of heated air 62 into the plurality of inner segments 14. In some alternative embodiments, the at least one distribution plenum 66 may be configured to distribute the flow of heated air 62 into a single inner segment 14.

Figure 10:
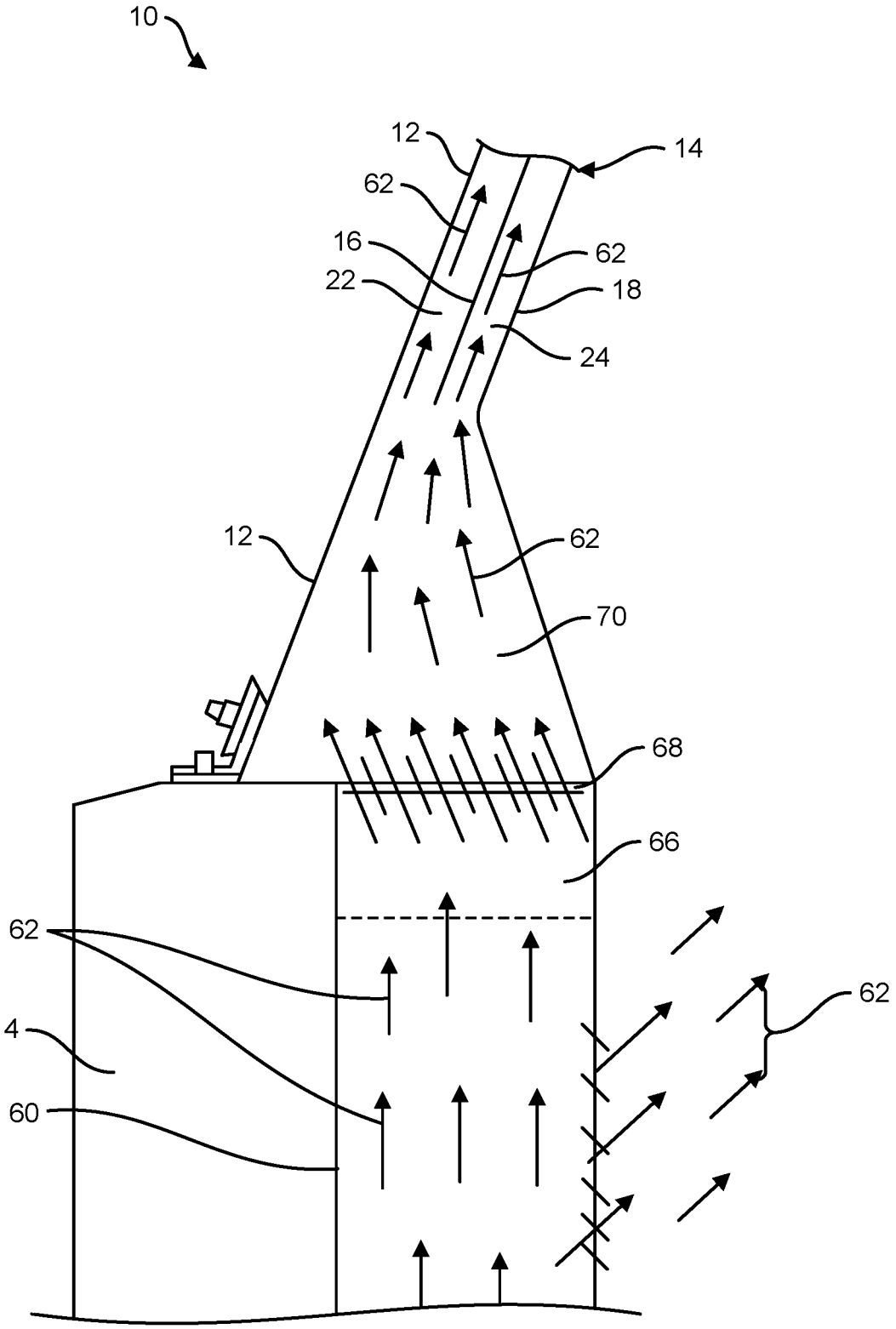
FIG. 10 is an enlarged cross-sectional view of a portion of the air supported structure of FIG. 3 as indicated in FIG. 9.

As shown in FIGS. 9-11, the at least one distribution plenum 66 may direct the flow of heated air 62 into one or more inner segments 14 of the structure 10 by directing the flow of heated air 62 into the first air pocket 22 and/or the second air pocket 24 thereof. For example, as shown in FIGS. 1 and 9-11, the at least one vent 68 of the at least one distribution plenum 66 may be in communication with a distribution pocket or space 70 to direct the flow of heated air 62 therein. The distribution pocket 70 may be a substantially closed off or sealed space but for the at least one vent 68 of the at least one distribution plenum 66 and the first air pocket 22 and/or the second air pocket 24 of the at least one inner segment 14 to direct the flow of heated air 62 into the first air pocket 22 and/or the second air pocket 24. The distribution pocket 70 may extend along the length of the structure 10 such and be in communication with a plurality of inner segments 14 to distribute the flow of heated air 62 into the first air pocket 22 and/or the second air pocket 24 of the plurality of inner segments 14. For example, a distribution pocket 70 may extend along the length of the structure 10 about the same length as an associated distribution plenum 66. As another example, a distribution pocket 70 may receive the flow of heated air 62 from a plurality of associated distribution plenums 66.

In some embodiments, the distribution pocket 70 may be formed by the outer membrane 12 being directly or indirectly coupled to an outer side of the at least one distribution plenum 66 and the inner-most liner panel 16, 18 being directly or indirectly coupled to an inner side of the at least one distribution plenum 66 such that the at least one vent 68 is positioned between the outer membrane 12 and the inner-most liner panel 16, 18. For example, in one exemplary embodiment, as shown in FIGS. 1, 9 and 10, the distribution pocket 70 may be formed by the outer membrane 12 extending (either directly or indirectly via filler panel) to the base structure 4 (or the ground 2), the at least one distribution plenum 66 being coupled to an inner side of the base structure 4 (or outer membrane 12), and the inner-most liner panel 16, 18 extending (either directly or indirectly via filler panel) to an interior portion of the at least one distribution plenum 66. In some such embodiments, the outer membrane 12 may extend to (and couple with) the base structure 4, and the second inner liner panel 18 may extend to (and couple with) the interior portion of the at least one distribution plenum 66. The first inner liner panel 16 may not extend to the base structure 4 and/or at least one distribution plenum 66. The end of the first inner liner panel 16 at the distribution pocket 70 may be spaced between the outer membrane 12 and the second inner liner panel 18 (to form the first air pocket 22 and the second air pocket 24, respectively), via gravity and/or the associated tab members 20 of the inner segments 14 as shown in FIGS. 1 and 10. In some other embodiments, the end of the first inner liner panel 16 at the distribution pocket 70 may be spaced between the outer membrane 12 and the second inner liner panel 18 (to form the first air pocket 22 and the second air pocket 24, respectively), via a frame or other structure (not shown). In some embodiments, a side or side portion of the structure 10 may only include single distribution pocket 70.

In some embodiments, the at least one inlet plenum 60 may include at least one valve or damper (not shown) positioned before and/or after the at least one vent 64 in the direction of flow configured to selectively close off or otherwise prevent the flow of heated air 62 from flowing past the valve or damper. For example, the at least one inlet plenum 60 may include a valve or damper positioned before the at least one vent 64 (not shown) in the direction of flow to selectively prevent the flow of heated air 62 from flowing to (and potentially through) the at least one vent 64 and the at least one inner segment 14. As another example, the at least one inlet plenum 60 may include a valve or damper positioned after the at least one vent 64 (not shown) but before the distribution plenum 66 in the direction of flow to selectively prevent the flow of heated air 62 from flowing within the at least one inner segment 14 in communication therewith.

As shown in FIGS. 3-5, 9 and 10, the frozen precipitation accumulation removal and prevention configurations, systems and methods of the air supported structure 10 may selectively direct or create the flow of heated air 62 through the first air pocket 22 and/or and the second air pocket 24 of one or more inner segments 14. As discussed above and shown in FIGS. 3-5, 9 and 10, an inner segment 14 of the structure 10 may be formed by the outer membrane 12, a pair of tab members 20, and at least one inner liner panel 16 extending between the pair of tab members to create a first air pocket or channel 22 between the outer membrane 12, the at least one inner liner panel 16 and the pair of tab members 20. As also discussed above and shown in FIGS. 3-5, 9 and 10, when the structure 10 includes first and second inner liner panels 16, and 18, an inner segment 14 creates a first air pocket or channel 22 between the outer membrane 12, the first inner liner panel 16 and the pair of tab members 20, and a second air pocket or channel 24 between the first inner liner panel 16, the second inner liner panel 18 and the pair of tab members 20.

The flow of heated air 62 within the first air pocket 22 and/or and the second air pocket 24 may act to heat the outer membrane 12 to, in turn, raise the temperature of any frozen precipitation accumulation 6 on the outer surface of the outer membrane 12 above its melting and/or evaporating point such that it flows and/or evaporates off the outer membrane 12 of the structure 10. Further, the flow of heated air 62 within the first air pocket 22 and/or and the second air pocket 24 may act to heat the outer membrane 12 to prevent the frozen precipitation accumulation 6 on the outer surface of the outer membrane 12. In some embodiments, structure 10 may be configures such that the heated air 62 within the flow of heated air 63 within the inner segments heats at least a portion of the outer surface of the outer membrane 12 to above 32 degrees, or above 35 degrees, or above 40 degrees. As noted above, the flow of heated air 62 through the first air pocket 22 and/or and the second air pocket 24 may be selectively activated or formed only when the outer membrane 12 includes frozen precipitation accumulation 6 or when frozen precipitation accumulation 6 may form.

As discussed above, only some of the inner segments 14 (one or more inner segment 14) of the structure 10 may be configured to directly receive the flow of heated air 62 (within the first air pocket 22 and/or and the second air pocket 24 thereof) via the at least one inlet plenum 60, at least one distribution channel 66 and/or at least one distribution pocket 70, as shown in FIG. 10. For example, inner segments 14 that extend through or along the most vulnerable or likely areas of the outer membrane 12 to include frozen precipitation accumulation 6 may directly receive the flow of heated air 6 (within the first air pocket 22 and/or and the second air pocket 24 thereof, as shown in FIG. 10. However, as noted above the body portion 32 of the tab members 20 may include through apertures 35, as shown in FIGS. 3 and 5-7. The through apertures 35 of the body portion 32 of the tab members 20 may thereby allow the flow of heated air 62 to flow from one inner segment 14 to an adjacent inner segment 14, as shown in FIGS. 5 and 7. Specifically, the through apertures 35 of the tab members 20 may allow the flow of heated air 62 to flow from one first air pocket 22 or second air pocket 24 to an adjacent to an adjacent first air pocket 22 or second air pocket 24, respectively, as shown in FIGS. 5 and 7. In this way, the although particular inner segments 14 may not be configured to directly receive the flow of the heated air 62, the flow of the heated air 62 may travel through the apertures 35 of the tab members 20 and migrate to such inner segments 14.

As also discussed above, the first air pocket 22 and second air pocket 24 of one or more inner segments 14 may be in communication via apertures 28 extending through the first inner liner panel 16 thereof, as shown in FIG. 7. As such, although only the first air pocket 22 or the second air pocket 24 of a particular inner segment 14 may be configured to directly receive the flow of heated air 62 (via the at least one inlet plenum 60, at least one distribution channel 66 and/or at least one distribution pocket 70), the through apertures 28 may allow the flow of heated air 62 to migrate between the first and second air pockets 22, 24 of the particular inner segment 14, as shown in FIG. 7. Similarly, as also discussed above the first air pocket 22 and/or the second air pocket 24 of one or more inner segments 14 may be in communication with the enclosure formed by the first air pocket 22 and/or the second air pocket 24 via the apertures 28, as shown in FIG. 7. As such, although the first air pocket 22 and/or the second air pocket 24 may be configured to directly receive the flow of heated air 62 (via the at least one inlet plenum 60, at least one distribution channel 66 and/or at least one distribution pocket 70), the through apertures 28 thereof may allow the flow of heated air 62 to migrate into the enclosure.

Figure 12:
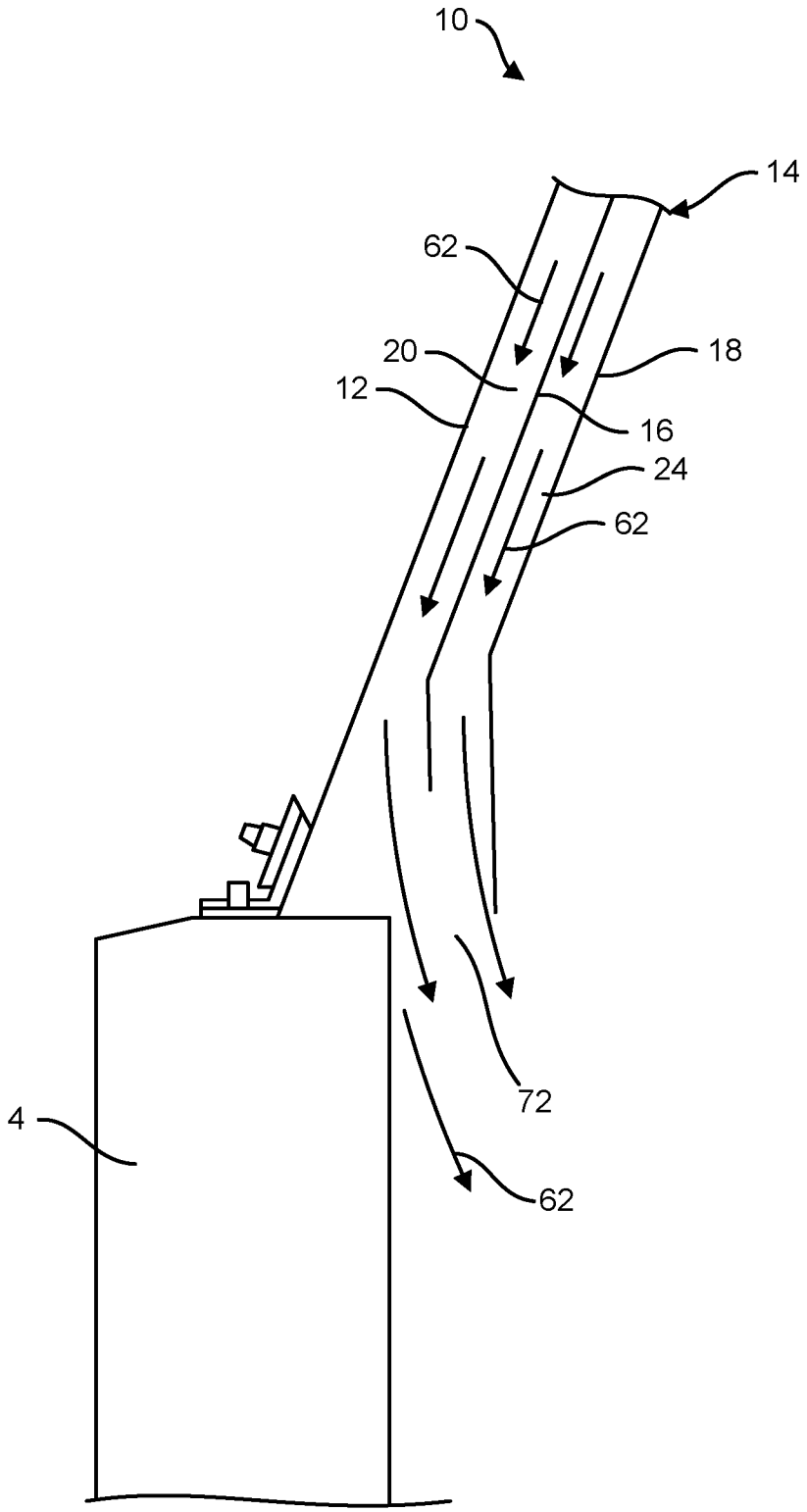
FIG. 12 is a cross-sectional view of a portion of the air supported structure of FIG. 3 illustrating a return of heated air into the structure and enclosure.
Figure 14:
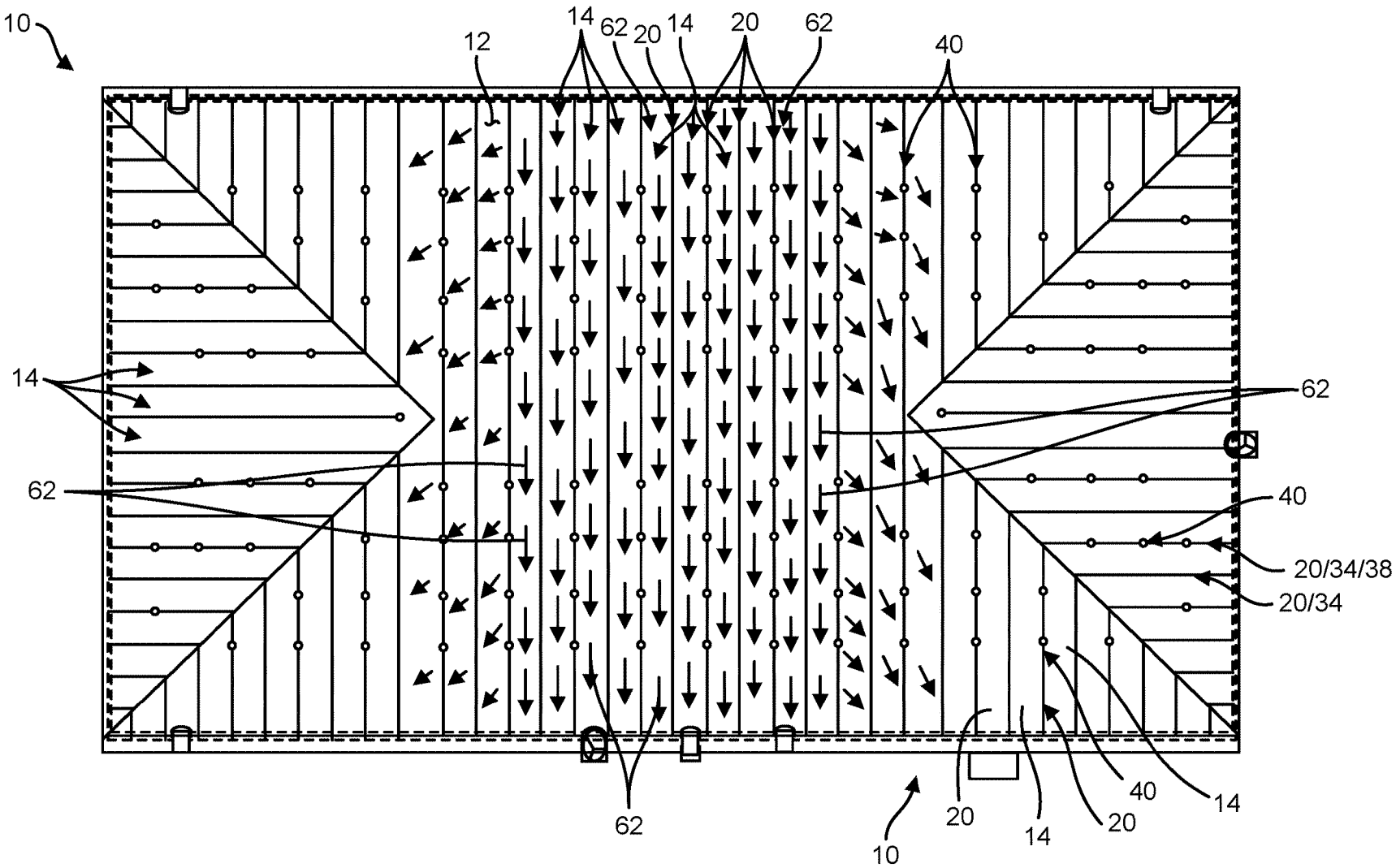
FIG. 14 is a top view of the air supported structure of FIG. 3 illustrating an exemplary network of inner segments thereof.

As shown in FIGS. 3 and 12, the flow of heated air 62 flowing through the at least one inner segment 14 (i.e., through the first and/or second air pockets 22, 24) may flow to at least one enclosure or output vent 72 after warming or heating the outer member 12. For example, as shown in FIGS. 3 and 14, the flow of heated air 62 may flow through the at least one inner segment 14 from one longitudinal side of the structure 10 to another longitudinal side across the width of the structure 10 to the output vent 72. The output vent 72 may be configured to direct or distribute the flow of heated air 62 into the enclosure, as shown in FIGS. 1 and 12. In this way, after the flow of heated air 62 heats the outer member 12, it may flow into the enclosure to warm the enclosure (which may act to further heat and/or maintain the temperature of the outer membrane 12). It is noted that one output vent 72 may be provided for each of a plurality of inner segments 14, or a plurality of inner segments 14 may share or utilize the same output vent 72.

As shown in FIGS. 3 and 12, in some embodiments the output vent 72 may be an aperture or space defining an end of the inner segment 14 that is in communication with the enclosure. In some embodiments, the output vent 72 may be an aperture or space formed between the outer membrane 12 and the inner-most inner liner panel 16, 18 that is in communication with the enclosure. For example, if the second inner liner panel 18 is utilized, the output vent 72 may be an aperture formed between the outer membrane 12 and the second inner liner panel 18 that is in communication with the enclosure, as shown in FIGS. 3 and 12. In some embodiments, the outer membrane 12 may be coupled (either directly or indirectly,) to the base structure 4 and/or the ground 2, and the inner-most inner liner panel 16, 18 may extend into and terminate within the enclosure (i.e., be spaced from the base structure 4 and/or the ground 2), as shown in FIGS. 3 and 12.

The end or end portion of the inner-most inner liner panel 16, 18 of an inner segment 14 that forms, in part, the output vent 72 may extend into and terminate within the enclosure via gravity and/or the pressure/force of the flow of heated air 62, as shown in FIGS. 3 and 12. For example, as shown in FIGS. 3 and 12 the second inner liner panel 18 of an inner segment 14 may form, in part, the output vent 72, by including a portion that extends into and terminates within the enclosure via gravity and/or the pressure/force of the flow of heated air 62. In some such embodiments, the portion of the second inner liner panel 18 that extends into and terminates within the enclosure may not be coupled to a tab member 20. In some other such embodiments, the portion of the second inner liner panel 18 that extends into and terminates within the enclosure may be coupled to a wider portion of at least one tab member 20. As shown in FIGS. 3 and 12, outer member 12 may be coupled to the base structure 4 and/or the ground 2, and the output vent 72 may be formed between an inner portion of the base structure 4 and/or the ground 2 and the inner-most inner liner panel 16, 18. In some embodiments, the first liner panel 16 may terminated before extending to the output vent 72, as shown in FIGS. 3 and 12.

Figure 13:
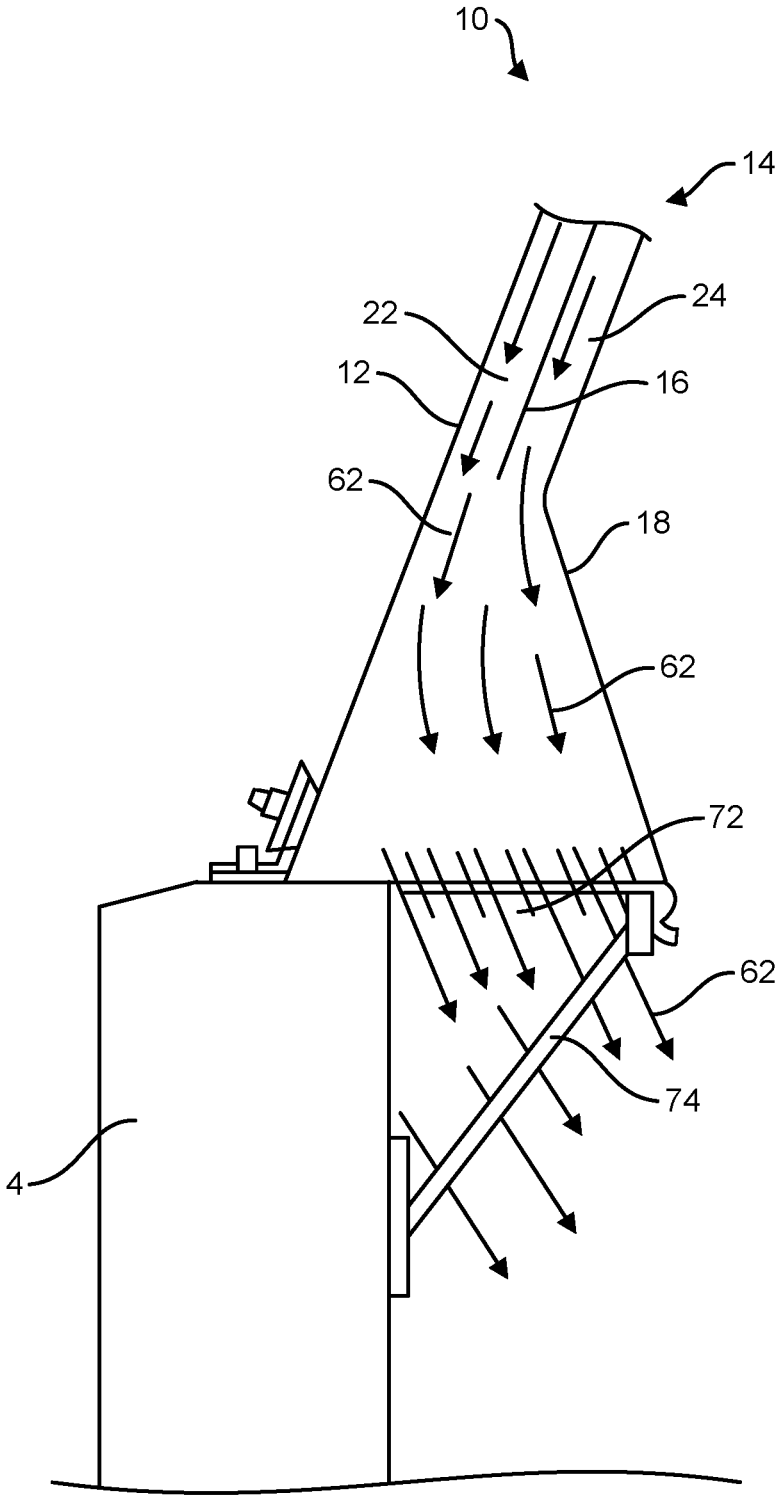
FIG. 13 is a cross-sectional view of a portion an alternative embodiment of the air supported structure of FIG. 3 illustrating a return of heated air into the structure and enclosure.

As shown in FIG. 13, in some embodiments the output vent 72 defining the end or end portion of an inner segment 14 may be formed via a hollow or open frame 74. The frame 74 may form one or more passageways therethrough to form the output vent 72, and physically space the end or end portion of the inner-most inner liner panel 16, 18 away from the end or end portion of the outer member 12. For example, as shown in FIG. 13, the outer member may be coupled to the base structure 4 of the structure 10, and the frame 74 may extend from the base structure inwardly into the enclosure and couple to the end or end portion of the inner-most inner liner panel 16, 18 (e.g., the second inner liner panel 18 as shown). The frame 74 may thereby space the inner-most inner liner panel 16, 18 from the base structure 4 to form the output vent 72 therebetween and through the frame 74.

As shown in FIG. 14, the structure 10 may be configured such that a network or pattern of inner segments 14, and thereby first air pockets 22 and potentially second air pockets 24, is provided within or along a substantial portion of the outer membrane 12 of the enclosure. As shown in FIG. 12, a plurality of inner segments 14 may be provided in a medial portion of the longitudinal length of the structure 10 that extend across the entirety of the lateral width of the enclosure. The first air pockets 22 (and potentially second air pockets 24) thereof thereby may thereby also extend across the entirety of the lateral width of the enclosure, the plurality of apertures 35 of the tab members 20 may be provided along the length thereof. The flow of heated air 62 may thereby also extend across the width of the enclosure within the first air pockets 22 (and potentially second air pockets 24), shown in FIG. 14.

As also shown in FIG. 14, a plurality of inner segments 14 may be provided at longitudinal ends in of the structure 10 that extend along a portion of the longitudinal length of the enclosure. The first air pockets 22 (and potentially second air pockets 24) thereof thereby may also extend along a portion of the longitudinal length of the enclosure, and the plurality of apertures 35 of the tab members 20 may be provided along the length thereof. The flow of heated air 62 may thereby also extend along a portion of the longitudinal length of the enclosure within the first air pockets 22 (and potentially second air pockets 24, shown in FIG. 12. The laterally and longitudinally extending first air pockets 22 (and potentially second air pockets 24), and spaced plurality of apertures 35 of the tab members 20 thereof, may thereby form an interconnected network of flows of heated air 62 to provide at least a substantial portion of the outer membrane 12 of the structure 10 with heated air to heat the outer membrane 12. It is noted, however, that a structure 10 may be configured or arranged differently than shown in FIG. 14 with any configuration or arrangement of the inner segments (i.e., the first air pockets 22, and potentially second air pockets 24), and apertures 35 of the tab members 20.

In some embodiments, the output vent 72 of at least one inner segment 14 may be selectively closable to prevent the flow of heated air 62 reaching the output vent 72 from flowing into the enclosure (not shown). In this way, in the closed state, the output vent 72 may "close" the end of the inner segment 14 opposite the end in which the flow of heated air 62 is directed or input into the inner segment 14. In the closed state, the output vent 72 may force the flow of heated air 62 flowing through the at least one inner segment 14 (i.e., through the first and/or second air pockets 22, 24) through the apertures 35 in the tab members 20 and/or through the apertures in the first and/or second liner panels 16, 18. The output vent 72 may thereby selectively force the flow of heated air 62 flowing through the at least one inner segment 14 into adjacent or neighboring inner segments 14. For example, at least one output vent 72 associated with at least one inner segment may be selectively closed to force the flow of heated air 62 into at least one segment 14 that extends along or through an area of the outer membrane 12 that requires or would benefit from additional heat. In such embodiments, the output vent 72 in communication with one or more inner segments 14 of the structure 10 can be selectively open or closed to direct the flow of heated air 62 to one or more air pockets 22, 24 in at least one area of the structure 10 to remove and/or prevent frozen precipitation accumulation 6 on the outer membrane 12 within the at least one area.

The flow of heated air 62 through the inner segments 14 may be thermostatically controlled. For example, the structure 10 may include at least one thermostat configured to control the blower and/or heating mechanism to selectively create the flow of heated air 62 when frozen precipitation accumulation removal or prevention from the outer member 12 is needed. In some embodiments, the structure 10 may include at least one thermostat associated with the output vent 72 and/or the inner segments 14 (e.g., positioned past an area of existing or likely frozen precipitation accumulation in the direction of flow) that controls the blower and/or heating mechanism to create a continuous or constant flow of the heated air 62 to remove and/or prevent frozen precipitation accumulation on the outer member 12. For example, a user may set the at least one thermostat to at a setpoint temperature or temperature range of the flow of heated air 62 that will not, or likely will not, be achieved by the blower and/or heating mechanism. In this way, the blower and/or heating mechanism will create a continuous flow of the heated air 62 through the inner segments 12.

FIGS. 15-18 illustrate another air supported structure 110 with an exemplary frozen precipitation accumulation removal and prevention configuration or system according to the present disclosure. The air supported structure 110 of FIGS. 15-18 is similar to the air supported structure 10 of FIGS. 1-14 described above, and therefore like reference numerals preceded with "1" are used to indicate like aspects, processes or functions, and the description above directed thereto (and the alternative embodiments thereof) equally applies to the air supported structure 110.

Figure 15:
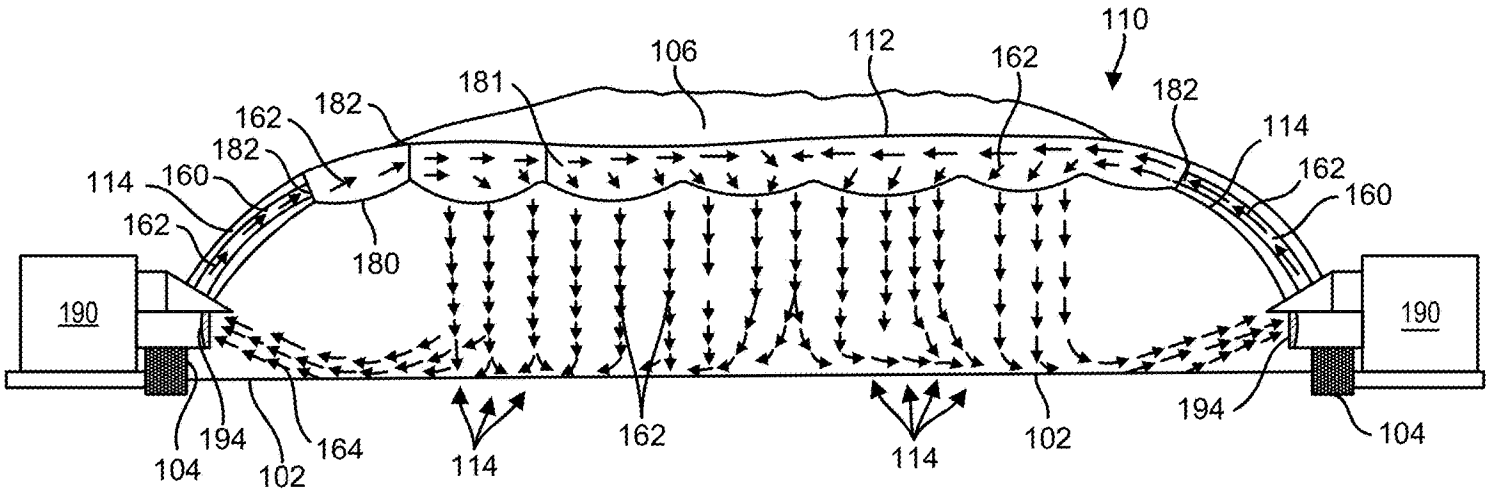
FIG. 15 is a cross-sectional view taken across the longitudinal length of another air supported structure with frozen precipitation accumulation thereon illustrating a snow melting mode thereof according to the present disclosure.
Figure 16:
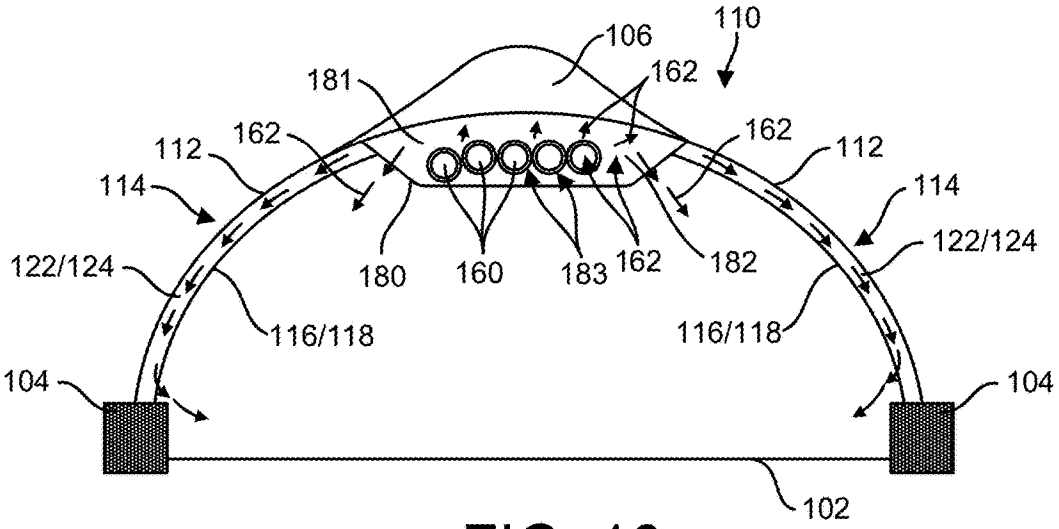
FIG. 16 is a cross-sectional view taken across the lateral width length of the air supported structure of FIG. 15.
Figure 17:
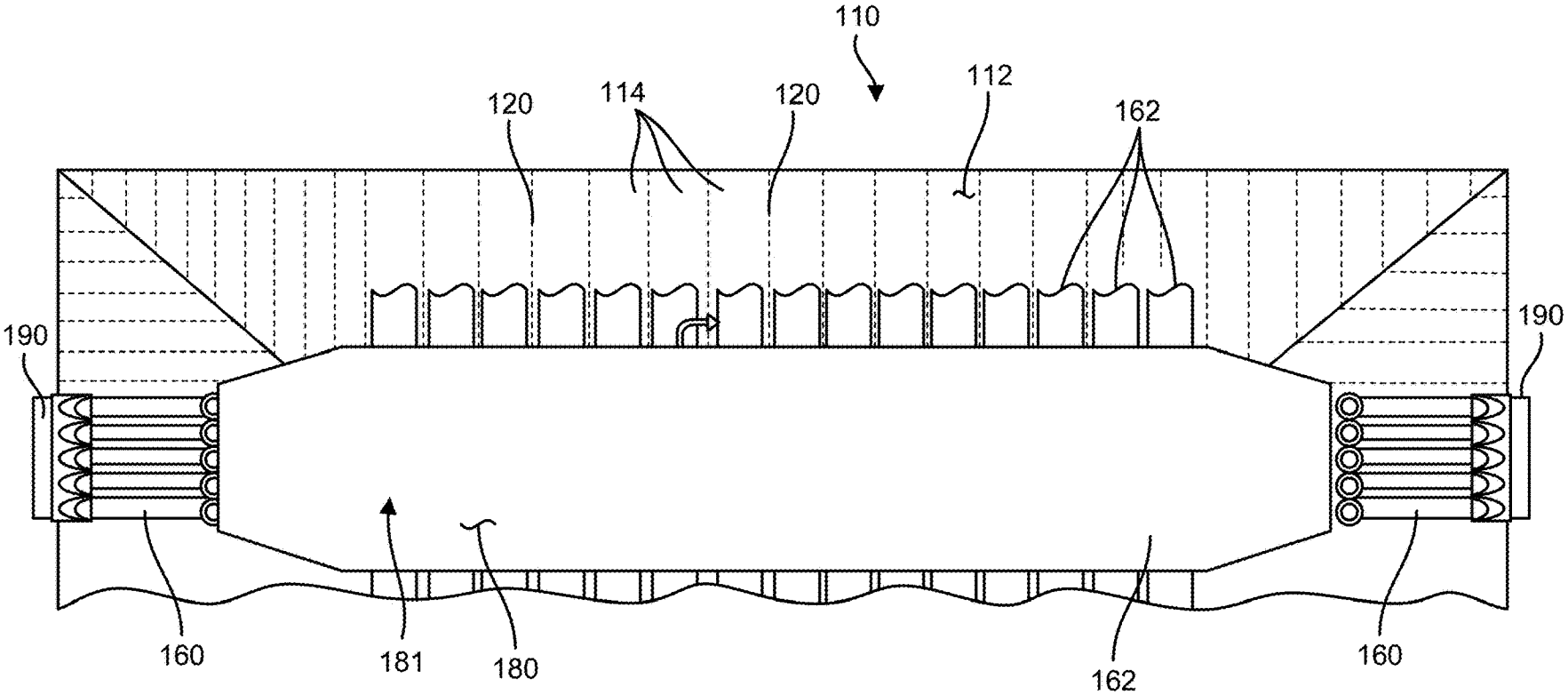
FIG. 17 is a top view of the air supported structure of FIG. 15.

As shown in FIGS. 15-17, the structure 110 may include an inner liner blanket 180 that extends along a length of a first portion of the outer member 112, such as where frozen precipitation is likely to accumulate. The inner liner blanket 180 may extend along the medial or central, and potentially highest, portion of the structure 10 for example, as shown in FIGS. 16 and 17. The inner liner blanket 180 may be coupled (directly or indirectly) to the outer membrane 112 to form a heating pocket 181 between the inner liner blanket 180 and the interior of the outer membrane 112 and is configured to heat the outer membrane 112. As shown in FIGS. 16 and 17, the structure 110 may include inner segments 114 with at least first air pockets 122 formed between the outer membrane 112 and inner liner panels 116 (and potentially second air pockets 124 formed between the first and second inner liner panels 116, 116), and the heating pocket 181 formed by the inner liner blanket 180 may be in communication with at least the first air pockets 122 of at least some the inner segments 114. For example, the inner segments 114 may extent to the inner liner blanket 180 and/or the heating pocket 181 such that at least the first air pockets 122 of the inner segments 114 are in communication with the heating pocket 181 to receive a flow of heated air 162 therefrom. In some embodiments, the structure 110 may include inner segments 114 that at least substantially surround and extend from the heating pocket 181 (such as proximate to the ground 2 and/or base structure 4 of the structure 10), and at least some of the inner segments 114 may be in communication with the heating pocket 181.

Figure 18:
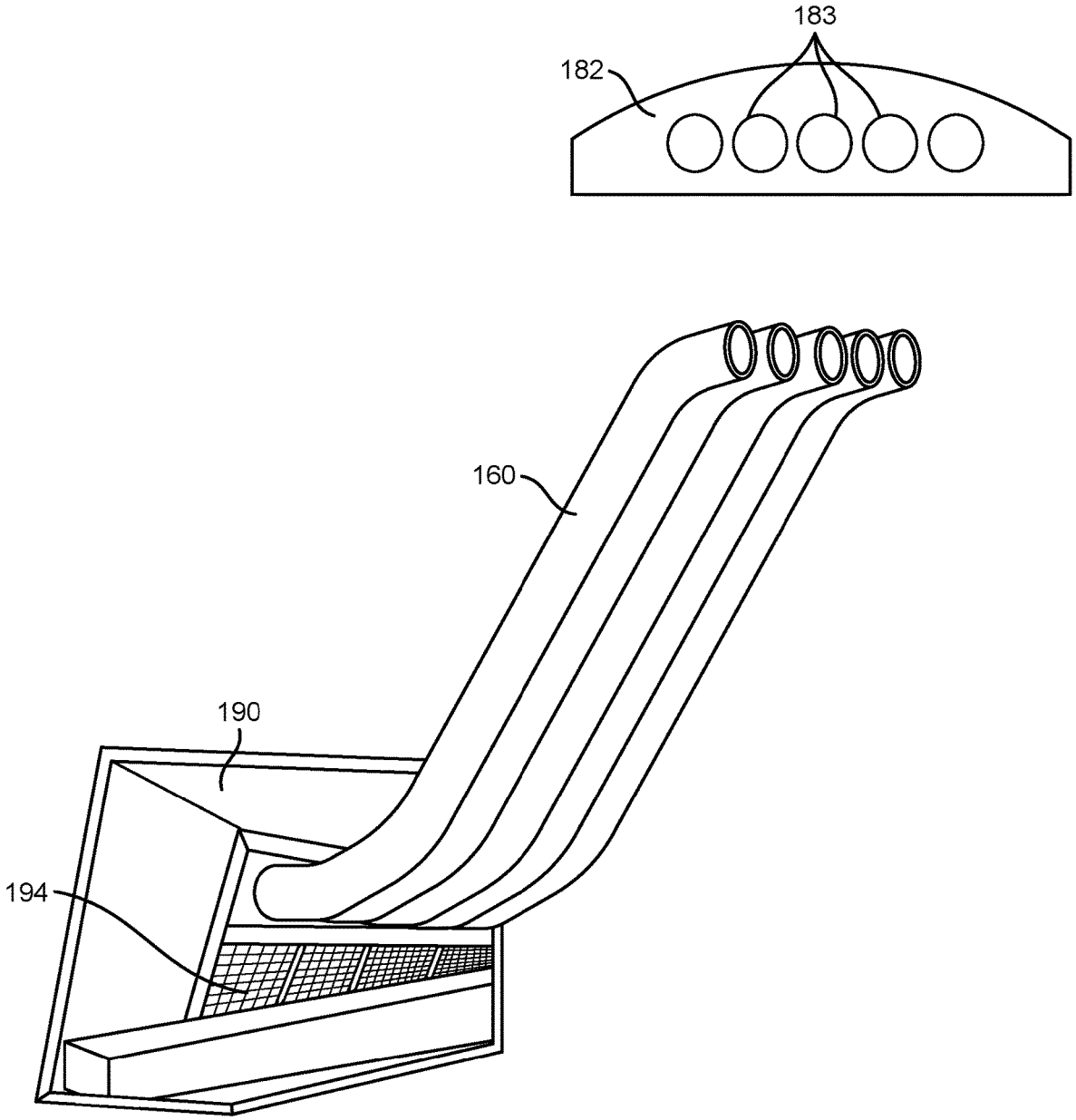
FIG. 18 is a perspective view of a blower, input ducts and a baffle of the air supported structure of FIG. 15.

As shown in FIGS. 15-18, the inner liner blanket 180 may be coupled to the outer membrane 112 via baffles 182 that are spaced along the length of the inner liner blanket 180 and the outer membrane 112 and extend therebetween. The baffles 182 may extend from the outer membrane 112 and toward the interior of the enclosure, and be coupled to an outer or exterior surface of the inner liner blanket 180, as shown in FIG. 15. The baffles 182 may thereby extend between the liner blanket 180 and the outer membrane 112 to couple the liner blanket 180 proximate to, but spaced from, the interior of the outer membrane 112 to form the air pocket 181, as shown in FIGS. 15 and 16. The baffles 182 may include at least one aperture 183 extending therethrough to allow air to flow 162 through the entirety of the second air pocket 181, as shown in FIGS. 16 and 18. In some embodiments, the inner liner blanket 180 may sag or form swags or festoons with the baffles 182 (i.e., the inner liner blanket 180 may hang in a downward curve as it extends between adjacent baffles 182), as shown in FIG. 15. In this way, the inner liner blanket 180 may form a scallop-shaped profile as it extends along the interior of the outer membrane 112 and from baffle 182 to baffle 182. At least a lower or inward portion of at least some of the swags or sagging portions of the inner liner blanket 180 positioned between two or more baffles 182 may be spaced from one or more adjacent inner segments 114 to form a gap or space therebetween that is in communication with the enclosure. In this way, as explained further below, heated air 162 flowing into/through the heating air pocket 181 may flow between the inner liner blanket 180 and the inner segments 114 and into the enclosure, as shown in FIG. 16.

In some embodiments, portions of the heating air pocket 181, such as opposing ends across an elongate portion thereof, formed between the inner liner blanket 180 and the outer membrane 112 may be coupled to one or more input or supply ducts or plenums 160 that extends from at least one blower and/or heating mechanism 190 configured to selectively create a flow of heated air 162 therethrough, and thereby into the heating air pocket 181, as shown in FIGS. 15, 17 and 18. The air supported structure 110 may thereby include at least one input plenum 160 at ends or end portions of the heating air pocket 181 that direct a flow of heated air 162 into ends or portions of the air pocket 181 between the inner liner blanket 180 and the outer membrane 112, as shown in FIGS. 15, 17 and 18. In some embodiments, the one or more supply ducts 160 may be coupled to one or more apertures 183 of a baffle 182 forming the heating pocket 181 to introduce a flow of heated air 162 into the heating pocket 181, as shown in FIG. 15. The at least one aperture 183 of such baffles 183 may allow the flow of heated air 162 to flow through the baffles 183, and thereby through the heating air pocket 181. Further, the at least one aperture 183 of the other baffles 182 forming the heating pocket 181 may allow the heated air 162 to flow through the heating pocket 181. In an alternative embodiment (not shown), the at least one blower and/or heating mechanism 190 may be configured to create the flow of heated air 162 through one or more inner segment 114 (e.g., the first and/or second air pocket 122, 124 thereof) and, thereby, into the heating pocket 181. In this way, the at least one input plenum 160 and/or at least one inner segment 114 may be in communication with the at least one blower and/or heating mechanism 190 and the heating pocket 181 such that the flow of heated air 162 flows into the heating pocket 181.

In some embodiments, the heating pocket 181 may be configured such that the flow of heated air 162 remains therein for a period of time before flowing into the enclosure via the inner segments 114 and/or the gaps between the inner segments 114 and the inner liner blanket 180. For example, the volume of the heating pocket 181 may be configured such that the flow of heated air 162 remains therein for a period of time. The flow of heated air 162 into the air pocket 181 may thereby act directly on a first portion of the outer membrane 112 (and structure 100) that forms the heating air pocket 181 to heat that portion of the outer membrane 112 and melt and/or prevent frozen precipitation accumulation 106 on the exterior surface thereof. The flow of heated air 162 may thereby be concentrated or directed to a first area of the outer membrane 112 that is most susceptible to frozen precipitation accumulation 106 (and thereby may include a load of frozen precipitation accumulation 106 thereon), such as the highest central portion of the structure, for example. The flow of heated air 162 may then flow through the heated air pocket 181 and to and through the inner segments 114 to heat secondary areas of the outer membrane 112 (and structure 110) extending from the first area of the outer membrane 112 (and structure 110) and the interior of the enclosure. If the first area of the outer membrane 112 (and structure 110) is positioned higher or above the secondary portions(s) as shown in FIGS. 15 and 16, the melted/liquid precipitation flowing from the outer surface of the first area of the outer membrane 112 (and structure 110) to/over the outer surface of the second area of the outer membrane 112 (and structure 110) may be kept at a temperature above freezing (i.e., prevented from freeing or re-freezing) so that the melted/liquid precipitation flows off the outer membrane 112 (and structure 110) entirely.

The flow of heated air 162 into the air pocket 181 (and thereby the inner segments 114 and interior of the enclosure) may be thermostatically controlled. For example, the structure 110 may include at least one thermostat configured to control the blower and/or heating mechanism 190 to selectively create the flow of heated air 162 into the air pocket 181 when frozen precipitation accumulation removal or prevention from the outer member 112 is needed. In some embodiments, the structure 110 may include at least one thermostat associated with the air pocket 181 and/or the inner segments 114 that controls the blower and/or heating mechanism 190 to create an intermittent or discontinuous flow of the heated air 162 into the air pocket 181 to remove and/or prevent frozen precipitation accumulation on the outer member 112. For example, a user may set the at least one thermostat to at a setpoint temperature or temperature range of the flow of heated air 162, such within the air pocket 181. Once the setpoint temperature or temperature range is reached, the at least one thermostat may cause the blower and/or heating mechanism 190 to stop forming the flow of the heated air 162, and thereby allow the heated air 162 within the air pocket 181 to remain therein and heat the outer membrane 112. As noted above, volume of the heating pocket 181 may be configured such that the heated air 162 may remain therein for a period of time sufficient to heat the outer membrane 112. The volume of the heating pocket 181 may also allow the heated air 162 within the air pocket 181 to relatively slowly cool. Once the heated air 162 within the air pocket 181 cools down and the setpoint temperature or temperature range is again reached, the at least one thermostat may cause the blower and/or heating mechanism 190 to again form the flow of the heated air 162 and allow the heated air 162 to fill the air pocket 181. In this way, the blower and/or heating mechanism 190 may create an intermittent flow of the heated air 162 into and/or through the air pocket 181.

As noted above, the inner segments 114 may extend from side portions of the inner liner blanket 180 and form the first and/or second air pockets 122, 124 between the tab members 120, as shown in FIG. 15-17. The heating air pocket 181 formed between the outer membrane 112 and the inner liner blanket 180 may be in communication with the air pocket(s) 122, 124 between the tab members 120 of the inner segments 114 such that the flow of heated air 162 through the air pocket 181 ultimately flows into the air pocket(s) 122, 124 of the inner segments 114, as shown in FIG. 15-17. The ends of the inner segments 114 opposing the inner liner blanket 180 may be in communication with the enclosure, as described above. Some of the flow of heated air 162 may thereby flow through the inlet plenum(s) 160 and/or inner segments 114, into and through the air pocket 181, through inner segments 114, and into the enclosure (after warming the outer membrane 112), as shown in FIG. 15-17. As also described above, a gap may be formed between the inner liner blanket 180 and the inner segments 114 as it droops between the baffles 182. Thereby, some of the flow of heated air 162 may alternatively flow through the inlet plenum(s) 160 and/or inner segments 114, into and through the air pocket 181, through the gaps between the inner liner blanket 180 and the inner segments 114, and into the enclosure (after warming the outer membrane 112), as shown in FIG. 15-17. The flow of the heated air 162 may thereby flow into the enclosure via the inner segments 144 and/or the gaps between the inner liner blanket 180 and the inner segments 114 after warming the outer membrane 112.

The heated air 162 flowing into the enclosure may act to heat the enclosure, and/or form or supplement the internal air pressure within the enclosure to maintain the outer membrane 112 in the elevated position. The at least one blower and/or heating mechanism 190 may also be in communication with a return vent or duct 194 that is in communication with the enclosure. The return vent 194 and the blower and/or heating mechanism 190 may be configured to pull or draw the air within the enclosure into the blower and/or heating mechanism 190, and form at least a portion of the flow of heated air 162 in the at least one input plenum 160 and/or inner segments 114 to feed the heating pocket 181 with the heated air 162. In this way, at least some of the air within the enclosure may be heated (potentially re-heated) and forced into and through the air pocket 181 to heat the outer membrane 112, and then return back into the enclosure. This cycle may be repeated to heat the outer membrane 112 (and the interior of the enclosure) to remove and prevent frozen precipitation accumulation on the outer surface of the membrane 112.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprise" (and any form of comprise, such as "comprises" and "comprising"), "have" (and any form of have, such as "has" and "having"), "include" (and any form of include, such as "includes" and "including"), "contain" (and any form contain, such as "contains" and "containing"), and any other grammatical variant thereof, are open-ended linking verbs. As a result, a method or article that "comprises", "has", "includes" or "contains" one or more steps or elements possesses those one or more steps or elements, but is not limited to possessing only those one or more steps or elements. Likewise, a step of a method or an element of an article that "comprises", "has", "includes" or "contains" one or more features possesses those one or more features, but is not limited to possessing only those one or more features.

As used herein, the terms "comprising," "has," "including," "containing," and other grammatical variants thereof encompass the terms "consisting of" and "consisting essentially of."

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed compositions or methods.

All publications cited in this specification are herein incorporated by reference as if each individual publication were specifically and individually indicated to be incorporated by reference herein as though fully set forth.

Subject matter incorporated by reference is not considered to be an alternative to any claim limitations, unless otherwise explicitly indicated.

Where one or more ranges are referred to throughout this specification, each range is intended to be a shorthand format for presenting information, where the range is understood to encompass each discrete point within the range as if the same were fully set forth herein.

While several aspects and embodiments of the present disclosure have been described and depicted herein, alternative aspects and embodiments may be affected by those skilled in the art to accomplish the same objectives. Accordingly, this disclosure and the appended claims are intended to cover all such further and alternative aspects and embodiments as fall within the true spirit and scope of the present disclosure.

The invention claimed is:

1. An air supported structure forming an enclosure with internal pressurized air, comprising:

an outer membrane with an inner side and an outer side that defines an outer surface of the structure;

an inner liner blanket coupled to the outer membrane via a plurality of spaced baffles extending from the outer membrane into the enclosure, the inner liner blanket and the inner surface of the outer membrane forming a heating pocket therebetween within the enclosure extending along a first portion of the outer membrane; the first portion comprising an apex portion of the outer membrane;

at least one input channel in communication with the heating pocket;

at least one heated air system configured to selectively direct a flow of heated air through the at least one input channel and into the heating pocket to heat the first portion of the outer membrane to remove and/or prevent frozen precipitation accumulation on the outer surface thereof; and a plurality of inner segments each formed by a pair of tab members extending from the outer membrane and at least one inner liner panel coupled to and extending between adjacent tab members spaced inwardly from the inner side of the outer membrane to form output channels therebetween, wherein the baffles include a plurality of outflow apertures extending therethrough that allow the flow of heated air to flow through the heating pocket along the first portion of the outer membrane, and wherein the output channels extend from proximate to the outflow apertures and along a second portion of the outer membrane, a first end of the plurality of output channels receiving at least a first portion of the flow of heated air from the heating pocket via the outflow apertures to heat the second portion of the outer membrane to remove and/or prevent frozen precipitation accumulation on the outer surface thereof.

2. The air supported structure of claim 1, wherein the plurality of baffles are spaced along a first direction, and wherein opposing sides of the inner liner blanket extending along the first direction are spaced from the inner surface of the outer membrane to form outflow apertures therebetween to facilitate the flow of the heated air therethrough.

3. The air supported structure of claim 2, wherein a portion of the flow of heated air from the heating pocket through the outflow apertures flows into an interior of the enclosure to heat the interior of the enclosure.

4. The air supported structure of claim 1, wherein the tab members include apertures extending therethrough such that adjacent output channels are in communication with each other.

5. The air supported structure of claim 1, wherein a second portion of the flow of heated air from the heating pocket through the outflow apertures flows into an interior of the enclosure to heat the interior of the enclosure.

6. The air supported structure of claim 1, wherein a second end of the plurality of output channels opposing the first end thereof is in communication with an interior of the enclosure.

7. The air supported structure of claim 1, wherein the inner liner blanket hangs downwardly into an interior of the enclosure between adjacent baffles.

8. The air supported structure of claim 1, wherein a first baffle of the plurality of spaced baffles defines a first end portion of the heating pocket, and wherein the at least one input channel is in communication with the plurality of apertures of the first baffle.

9. The air supported structure of claim 1, wherein the at least one heated air system is configured to draw air from an interior of the enclosure via a return duct, and wherein at least a portion of the flow of heated air comprises air drawn from the interior of the enclosure via the return duct and heated by the at least one heated air system.

10. The air supported structure of claim 1, wherein the first portion of the outer membrane comprises a central portion of the structure, and a second portion of the outer membrane compromises a peripheral portion of the structure extending from the central portion thereof.

11. The air supported structure of claim 10, wherein the central portion of the structure is the highest portion of the structure, and the peripheral portion of the structure extends downwardly from the central portion.

12. The air supported structure of claim 1, wherein the at least one input channel comprises a pair of input channels in communication with opposing longitudinal end portions of the heating pocket.

13. The air supported structure of claim 12, wherein the at least one heated air system comprises a pair of heating air systems, the pair of input channels receiving the flow of heated air from a respective heating air system of the pair of heating air systems.

14. The air supported structure of claim 12, wherein lateral end portions of the heating pocket extending between the longitudinal ends and are open to an interior of the enclosure.

15. A method, comprising:

removing and/or preventing frozen precipitation accumulation on an outer surface of an air supported structure that forms an enclosure with internal pressurized air, wherein the air supported structure comprises:

an outer membrane with an inner side and an outer side that defines the outer surface of the structure;

an inner liner blanket coupled to the outer membrane via a plurality of spaced baffles extending from the outer membrane into the enclosure, the inner liner blanket and the inner surface of the outer membrane forming a heating pocket therebetween within the enclosure extending along a first portion of the outer membrane; the first portion comprising an apex portion of the outer membrane;

at least one input channel in communication with the heating pocket;

at least one heated air system configured; and a plurality of inner segments each formed by a pair of tab members extending from the outer membrane and at least one inner liner panel coupled to and extending between adjacent tab members spaced inwardly from the inner side of the outer membrane to form output channels therebetween, wherein the baffles include a plurality of outflow apertures extending therethrough that allow an air to flow through the heating pocket along the first portion of the outer membrane, and wherein the output channels extend from proximate to the outflow apertures and along a second portion of the outer membrane, a first end of the plurality of output channels receiving at least a first portion of the flow of air from the heating pocket via the outflow apertures, and wherein the removing and/or preventing frozen precipitation accumulation on the outer surface of the structure comprises selectively directing a flow of heated through at least one input channel and into the heating pocket and the output channels via the at least one heated air system to heat the outer membrane.

16. The method of claim 15, further comprising directing the flow of heated air from the heating pocket into the enclosure.

* * * * *